US007841915B2

(12) United States Patent
Bourret et al.

(10) Patent No.: US 7,841,915 B2
(45) Date of Patent: Nov. 30, 2010

(54) JET PROPULSION TRIM AND REVERSE SYSTEM

(75) Inventors: Michel Bourret, Drummondville (CA); Andre Denis, Sherbrooke (CA); Marc Schuler, Sherbrooke (CA)

(73) Assignee: Bombardier Recreational Products, Inc., Valcourt (CA)

( * ) Notice: Subject to any disclaimer, the term of this patent is extended or adjusted under 35 U.S.C. 154(b) by 485 days.

(21) Appl. No.: 11/962,396

(22) Filed: Dec. 21, 2007

(65) Prior Publication Data

US 2010/0041286 A1 Feb. 18, 2010

(51) Int. Cl.
*B63H 11/11* (2006.01)

(52) U.S. Cl. ..... 440/41; 440/42

(58) Field of Classification Search ..... 440/38, 440/40, 41, 42, 43
See application file for complete search history.

(56) References Cited

U.S. PATENT DOCUMENTS

| | | | | |
|---|---|---|---|---|
| 5,154,650 | A * | 10/1992 | Nakase | 440/41 |
| 5,304,078 | A * | 4/1994 | Kaneko | 440/41 |
| 5,474,007 | A | 12/1995 | Kobayashi | |
| 5,494,464 | A | 2/1996 | Kobayashi et al. | |
| 5,507,672 | A | 4/1996 | Imaeda | |
| 5,752,864 | A * | 5/1998 | Jones et al. | 440/41 |
| 5,755,601 | A | 5/1998 | Jones | |
| 6,045,418 | A | 4/2000 | Roos | |
| 6,113,443 | A | 9/2000 | Eichinger | |
| 6,234,100 | B1 | 5/2001 | Fadeley et al. | |
| 6,401,644 | B2 | 6/2002 | Fadeley et al. | |
| 6,453,835 | B2 | 9/2002 | Fadeley et al. | |
| 6,533,623 | B2 | 3/2003 | Simard et al. | |
| 6,547,611 | B1 | 4/2003 | Boroos et al. | |
| 6,676,462 | B2 | 1/2004 | Yanagihara | |
| 6,722,632 | B2 | 4/2004 | Kenny et al. | |
| 6,743,062 | B1 | 6/2004 | Jones | |
| 6,875,065 | B2 | 4/2005 | Tsuchiya et al. | |
| 6,905,378 | B2 | 6/2005 | Uraki et al. | |
| 7,195,527 | B2 | 3/2007 | Tani et al. | |
| 2003/0077954 | A1 | 4/2003 | Fadeley et al. | |
| 2008/0133075 | A1 | 6/2008 | St-Pierre et al. | |
| 2008/0182463 | A1 | 7/2008 | St-Pierre et al. | |
| 2008/0233811 | A1 | 9/2008 | St-Pierre et al. | |

FOREIGN PATENT DOCUMENTS

WO WO/2008-025169 A1 3/2008

* cited by examiner

*Primary Examiner*—Lars A Olson
(74) *Attorney, Agent, or Firm*—Osler, Hoskin & Harcourt LLP

(57) ABSTRACT

A watercraft has a jet pump and a venturi. A variable trim system (VTS) support and a reverse gate are rotationally mounted relative to the venturi. A steering nozzle is rotationally mounted to the VTS support. A rotary actuator has an output portion operatively connected to at least one of the VTS support and the reverse gate. Rotation of the output portion between a first angle and a second angle causes a rotation of the VTS support while the reverse gate remains in a stowed position relative to the steering nozzle. Rotation of the output portion between the second angle and a third angle causes a rotation of the reverse gate between the stowed position and a second position while the VTS support remains in a fixed position. A jet propulsion system and a method of operating a jet propulsion system are also disclosed.

19 Claims, 22 Drawing Sheets

JET PROPULSION TRIM AND REVERSE SYSTEM

FIELD OF THE INVENTION

The present invention relates to jet propulsion systems having a variable trim system and a reverse gate.

BACKGROUND OF THE INVENTION

There exist many different ways to propel watercraft. One way is to use what is known as a jet propulsion system which is powered by an engine of the watercraft. The jet propulsion system typically consists of a jet pump which pressurizes water from the body of water and expels it through a venturi as a jet rearwardly of the watercraft to create thrust. Usually, a steering nozzle is pivotally mounted rearwardly of the venturi. The steering nozzle is operatively connected to a steering assembly of the watercraft which causes it to turn left or right to redirect the jet of water and thereby steer the watercraft.

To be able to move in the reverse direction, the jet propulsion system of these watercraft are usually provided with a reverse gate. The reverse gate is movable between a stowed position and a reverse position. In the stowed position, the reverse gate does not interfere with the jet of water coming from the steering nozzle, thus allowing the watercraft to move forward. In the reverse position, the reverse gate redirects the jet of water coming from the steering nozzle towards a front of the watercraft, thus causing the watercraft to move in a reverse direction. The reverse gate is typically manually activated by the driver via a lever positioned near the driver. Cables and linkages are used to connect the lever with the reverse gate. In some watercraft, the lever is electrically connected to an electric motor which moves the reverse gate between its various positions.

Some watercraft are also provided with a variable trim system (VTS) which allows the adjustment of the orientation of the watercraft (about a laterally extending axis) with respect to the water as the watercraft is moving. In one type of VTS, the steering nozzle is gimbaled and can pivot about a horizontal axis to redirect the jet of water slightly up or down to adjust the trim. A VTS can be mechanically or electrically activated. In mechanical versions, a finger activated lever on the steering assembly is connected to a push-pull cable linked to the gimbal. The lever causes the cable to push or pull on the gimbal and thus rotate the steering nozzle in the desired direction. In electric versions, an electric motor is operatively connected to the gimbal so as to rotate it to obtain the desired position of the steering nozzle. Buttons located near the steering assembly send electrical signals to the electric motor to control the position of the steering nozzle.

Although a VTS and a reverse gate are often both provided in jet propulsion systems, each is provided with its own independent mechanism and actuation system. This can lead to increased complexity and increased cost due to the number of parts necessary. Also, the space available around a jet propulsion system is typically minimal and providing two separate mechanisms (one for the VTS and one for the reverse gate) can prove difficult.

Therefore, there is a need for a watercraft and a jet propulsion for a watercraft which has a VTS and a reverse gate which does not require two independent mechanisms and actuation systems.

SUMMARY OF THE INVENTION

It is an object of the present invention to ameliorate at least some of the inconveniences present in the prior art.

It is also an object of the present invention to provide a jet propulsion system having a variable trim system and a reverse gate, where the reverse gate moves with a steering nozzle as it is being trimmed, and where the reverse gate is actuated when the steering nozzle is in a trim down position.

It is another object of the present invention to provide a watercraft having the above jet propulsion system.

It is a further object of the present invention to provide a method of operating the above jet propulsion system.

In one aspect, the invention provides a watercraft having a hull, a deck disposed on the hull, an engine compartment defined between the hull and the deck, an engine disposed in the engine compartment, a steering assembly disposed at least in part on the deck, a jet pump connected to the hull and being operatively connected to the engine, and a venturi connected to a rearward end of the jet pump. A variable trim system (VTS) support is rotationally mounted relative to the venturi about a VTS axis. The VTS axis extends generally laterally and horizontally. A steering nozzle is rotationally mounted to the VTS support about a steering axis such that the steering nozzle rotates about the VTS axis with the VTS support. The steering axis is generally perpendicular to the VTS axis. The steering nozzle is operatively connected to the steering assembly and being disposed at least in part rearwardly of the venturi. A reverse gate is rotationally mounted relative to the venturi about a reverse gate axis. The reverse gate axis extends generally laterally and horizontally. A rotary actuator has an output portion operatively connected to at least one of the VTS support and the reverse gate. The output portion is rotatable between a first angle, a second angle, and a third angle. Rotation of the output portion between the first angle and the second angle causes a rotation of the VTS support about the VTS axis while a position of the reverse gate relative to the VTS support remains substantially the same, the position of the reverse gate relative to the VTS support being a stowed position. Rotation of the output portion between the second angle and the third angle causes a rotation of the reverse gate about the reverse gate axis between the stowed position and a second position while the VTS support remains in a fixed position relative to the venturi. The second position being a position wherein the reverse gate redirects a jet of water expelled from the steering nozzle when the engine is in operation.

In an further aspect, the VTS support is a VTS ring encircling at least a portion of the steering nozzle. The steering nozzle is rotationally mounted to the VTS ring about the steering axis at a top and at a bottom of the VTS ring.

In an additional aspect, the reverse gate is rotationally mounted to the VTS support about the reverse gate axis. The reverse gate axis is coaxial with the VTS axis.

In a further aspect, the reverse gate is rotationally mounted to the VTS support about the reverse gate axis. The reverse gate axis is disposed rearwardly of the VTS axis. Rotation of the output portion between the first angle and the second angle causes movement of the reverse gate axis in an arc about the VTS axis.

In an additional aspect, a main support is rotationally mounted relative to the venturi about a main support axis. The main support axis extends generally laterally and horizontally and being disposed forwardly of the VTS axis. The reverse gate is operatively connected to the main support. The output portion of the rotary actuator is connected to the main support. An axis of rotation of the output portion is coaxial with the main support axis.

In a further aspect, the rotary actuator having the output portion is a first rotary actuator having a first output portion. A second rotary actuator has a second output portion. The second output portion of the second rotary actuator is connected to the VTS support for rotating the VTS support. An axis of rotation of the second output portion is coaxial with the VTS axis.

In an additional aspect, a tunnel is formed in the hull. The tunnel has a front wall, a top wall, and two side walls. A ride plate is mounted to the hull for at least partially closing a bottom of the tunnel. The jet pump is disposed at least in part in the tunnel. The VTS support is rotationally mounted to the two side walls of the tunnel about the VTS axis. The main support is rotationally mounted to at least one of the two side walls of the tunnel about the main support axis.

In a further aspect, the rotary actuator is disposed inside the hull adjacent one of the two side walls of the tunnel.

In another aspect, the invention provides a jet propulsion system having a jet pump, and a venturi connected to an end of the jet pump. A variable trim system (VTS) support is rotationally mounted relative to the venturi about a VTS axis. The VTS axis extends generally laterally and horizontally. A steering nozzle is rotationally mounted to the VTS support about a steering axis such that the steering nozzle rotates about the VTS axis with the VTS support. The steering axis is generally perpendicular to the VTS axis. The venturi is disposed longitudinally between the jet pump and the steering nozzle. A reverse gate is rotationally mounted to the VTS support about a reverse gate axis. The reverse gate axis extends generally laterally and horizontally. A main support is rotationally mounted relative to the venturi about a main support axis. The main support axis extends generally laterally and horizontally. The VTS axis is disposed rearwardly of the main support axis. At least one link has a first portion pivotally connected to the main support and a second portion pivotally connected to the reverse gate.

In an additional aspect, the VTS support is a VTS ring encircling at least a portion of the steering nozzle. The steering nozzle is rotationally mounted to the VTS ring about the steering axis at a top and at a bottom of the VTS ring.

In a further aspect, the VTS axis is disposed longitudinally between the reverse gate axis and the main support axis.

In an additional aspect, the venturi has a stopper portion disposed on a lower portion thereof. The VTS support, the reverse gate, and the main support are movable between a first arrangement, a second arrangement, and a third arrangement. When in the first arrangement, the main support is in a first position, the reverse gate is in a stowed position relative to the steering nozzle and contacts the VTS support at a contact point located vertically higher than the reverse gate axis, and a bottom portion of the VTS support is spaced from the stopper portion of the venturi. When in the second arrangement, the main support is in a second position rotated in a first direction from the first position, the reverse gate is in the stowed position and contacts the VTS support at the contact point, and the bottom portion of the VTS support contacts the stopper portion of the venturi. When in the third arrangement, the main support is in a third position rotated in the first direction from the second position, the reverse gate is in a position where the reverse gate redirects a jet of water expelled from the steering nozzle when the jet propulsion system is in operation, the reverse gate is spaced from the contact point, and the bottom portion of the VTS support contacts the stopper portion of the venturi.

In a further aspect, a first guide pin is disposed on the VTS support vertically higher than the VTS axis. The main support defines a contact surface on a rearwardly facing side thereof. As the VTS support, the reverse gate, and the main support are moved between the first arrangement and the second arrangement the first guide pin contacts the contact surface.

In an additional aspect, the main support defines a slot therein. The slot defines an opening at an upper end of the contact surface. As the VTS support, the reverse gate, and the main support are moved between the second arrangement and the third arrangement the first guide pin is disposed in the slot.

In a further aspect, a second guide pin disposed on the VTS support vertically higher than the VTS axis and vertically lower than the first guide pin. The main support defines a ramp. The ramp has an arcuate surface. The arcuate surface corresponds to a segment of a circle having the main support axis as a center. When the steering nozzle, the reverse gate, and the main support are moved between the second arrangement and the third arrangement the second guide pin contacts the arcuate surface of the ramp.

In an additional aspect, an actuator is operatively connected to the main support for rotating the main support about the main support axis.

In yet another aspect, the invention provides a method of operating a jet propulsion system. The jet propulsion system includes a jet pump, a venturi connected to the jet pump, a variable trim system (VTS) support rotationally mounted relative to the venturi about a VTS axis, the VTS axis extending generally laterally and horizontally, a steering nozzle rotationally mounted to the VTS support about a steering axis such that the steering nozzle rotates about the VTS axis with the VTS support, the steering axis being generally perpendicular to the VTS axis, a reverse gate rotationally mounted relative to the venturi about a reverse gate axis, the reverse gate axis extending generally laterally and horizontally, and a rotary actuator having an output portion operatively connected to the VTS support. The method comprises: rotating the output portion of the rotary actuator in a first direction thereby causing the VTS support to rotate from a VTS up position to a VTS down position about the VTS axis; moving the reverse gate such that a position of the reverse gate relative to the VTS support remains substantially the same as the VTS support is rotated, the reverse gate being in a stowed position relative to the steering nozzle; and continuing to rotate the output portion of the rotary actuator in the first direction once the VTS support reaches the VTS down position thereby causing the reverse gate to rotate from the stowed position to a second position where the reverse gate redirects a jet of water expelled from the steering nozzle when the jet propulsion system is in operation, the VTS support remaining in the VTS down position as the reverse gate is rotated from the stowed position to the second position.

In a further aspect, moving the reverse gate such that a position of the reverse gate relative to the VTS support remains substantially the same as the VTS support is rotated includes moving the reverse gate axis in an arc about the VTS axis as the VTS support is rotated from the VTS up position to the VTS down position.

In an additional aspect, the jet propulsion system further includes a main support rotationally mounted relative to the venturi about a main support axis, the main support axis extending generally laterally and horizontally and being disposed forwardly of the VTS axis, the reverse gate being operatively connected to the main support, and the output portion of the rotary actuator being operatively connected to the main support. Rotating the output portion of the rotary actuator in a first direction thereby causing the VTS support to rotate from a VTS up position to a VTS down position about the VTS axis includes: rotating the main support in the first direction using the output portion of the rotary actuator thereby causing rotation of the VTS support from the VTS up position to the VTS down position. Continuing to rotate the output portion of the rotary actuator in the first direction once the VTS support reaches the VTS down position includes: continuing to rotate the main support in the first direction using the rotary actuator thereby causing rotation of the reverse gate from the stowed position to the second position.

For purposes of this application, terms related to spatial orientation such as forwardly, rearwardly, left, and right, are as they would normally be understood by a driver of the watercraft sitting thereon in a normal driving position. It should be understood that terms related to spatial orientation when referring to the jet propulsion system alone should be understood as they would normally be understood when the jet propulsion system is installed on a watercraft.

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF THE PREFERRED EMBODIMENTS

The present invention will be described with respect to a personal watercraft and a jet boat. However, it should be understood that other types of watercraft are contemplated.

The general construction of a personal watercraft 10 in accordance with this invention will be described with respect to FIGS. 1-5. The following description relates to one way of manufacturing a personal watercraft. Obviously, those of ordinary skill in the watercraft art will recognize that there are other known ways of manufacturing and designing watercraft and that this invention would encompass other known ways and designs.

Figure 1:
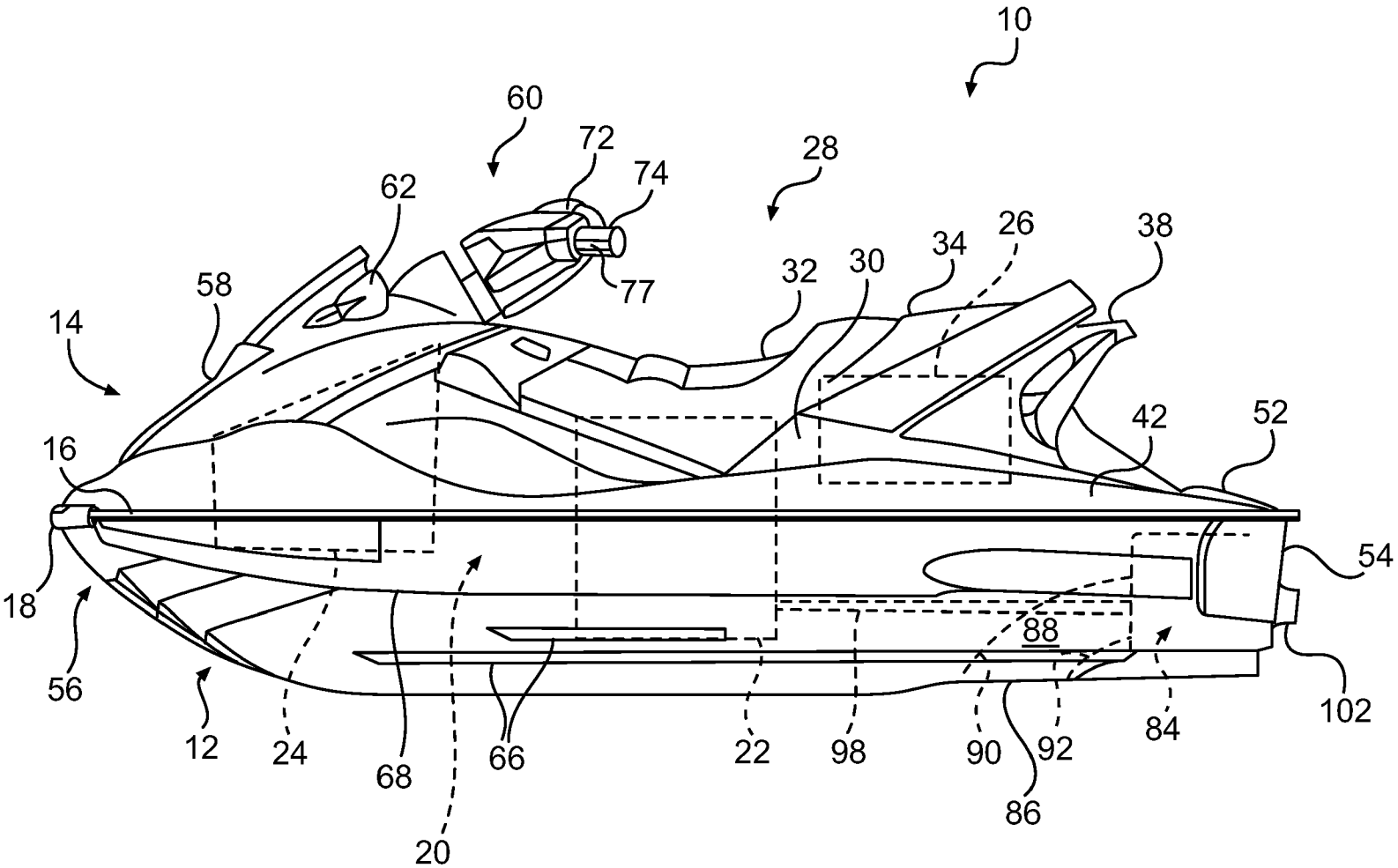
FIG. 1 illustrates a side view of a personal watercraft in accordance with the invention.

The watercraft 10 of FIG. 1 is made of two main parts, including a hull 12 and a deck 14. The hull 12 buoyantly supports the watercraft 10 in the water. The deck 14 is designed to accommodate a rider and, in some watercraft, one or more passengers. The hull 12 and deck 14 are joined together at a seam 16 that joins the parts in a sealing relationship. Preferably, the seam 16 comprises a bond line formed by an adhesive. Of course, other known joining methods could be used to sealingly engage the parts together, including but not limited to thermal fusion, molding or fasteners such as rivets or screws. A bumper 18 generally covers the seam 16, which helps to prevent damage to the outer surface of the watercraft 10 when the watercraft 10 is docked, for example. The bumper 18 can extend around the bow 56, as shown, or around any portion or all of the seam 16.

The space between the hull 12 and the deck 14 forms a volume commonly referred to as the engine compartment 20 (shown in phantom). Shown schematically in FIG. 1, the engine compartment 20 accommodates an engine 22, as well as a muffler, tuning pipe, gas tank, electrical system (battery, electronic control unit, etc.), air box, storage bins 24, 26, and other elements required or desirable in the watercraft 10.

Figure 2:
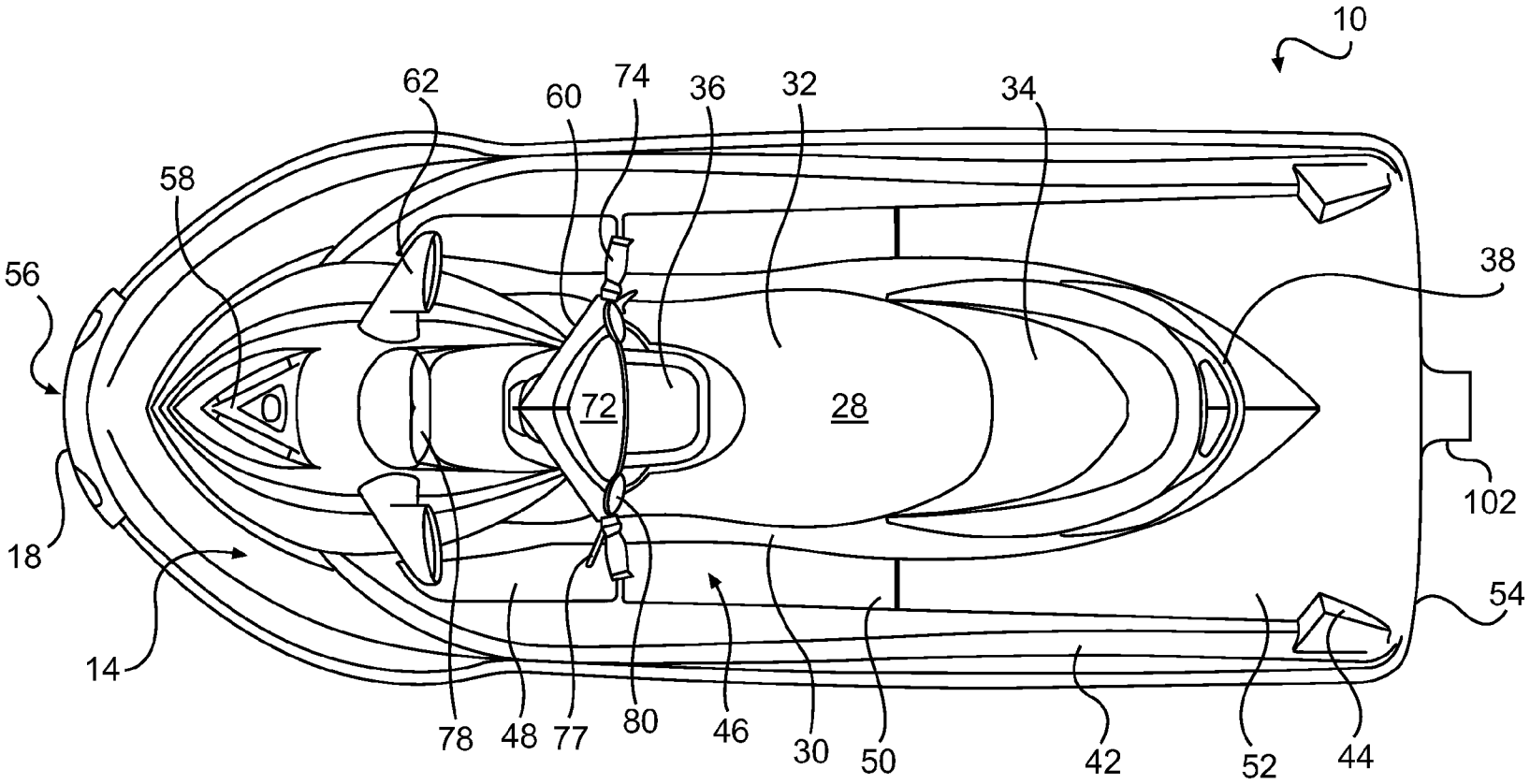
FIG. 2 is a top view of the watercraft of FIG. 1.

As seen in FIGS. 1 and 2, the deck 14 has a centrally positioned straddle-type seat 28 positioned on top of a pedestal 30 to accommodate a rider in a straddling position. The seat 28 is sized to accommodate one or more riders. As seen in FIG. 2, the seat 28 includes a first, front seat portion 32 and a rear, raised seat portion 34 that accommodates a passenger.

The seat 28 is preferably made as a cushioned or padded unit or interfitting units. The first and second seat portions 32, 34 are removably attached to the pedestal 30 by a hook and tongue assembly (not shown) at the front of each seat and by a latch assembly (not shown) at the rear of each seat, or by any other known attachment mechanism. The seat portions 32, 34 can be individually tilted or removed completely. One of the seat portions 32, 34 covers an engine access opening (in this case above engine 22) defined by a top portion of the pedestal 30 to provide access to the engine 22 (FIG. 1). The other seat portion (in this case portion 34) covers a removable storage box 26 (FIG. 1). A "glove compartment" or small storage box 36 is provided in front of the seat 28.

Figure 4:
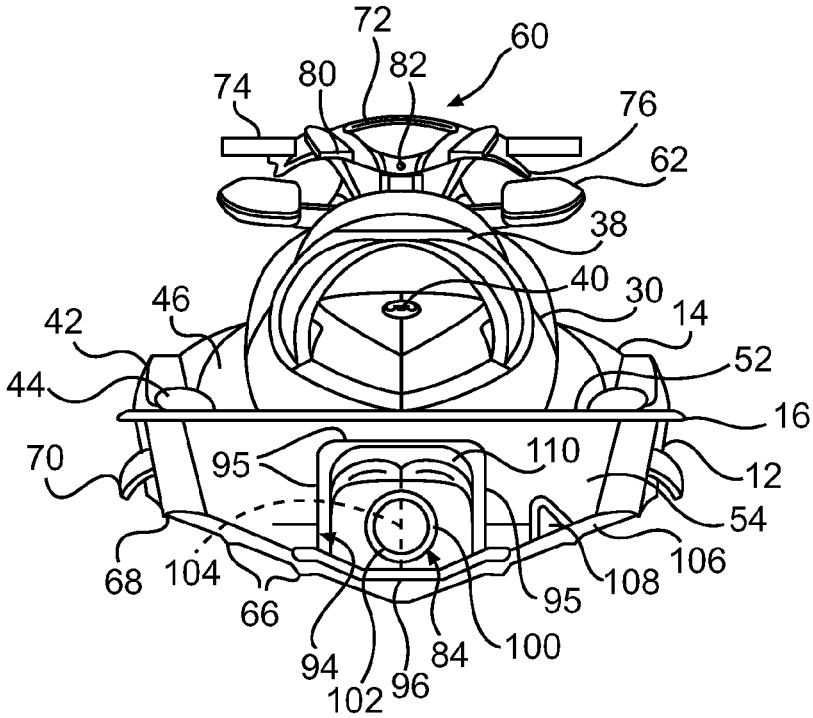
FIG. 4 is a back view of the watercraft of FIG. 1.

As seen in FIG. 4, a grab handle 38 is provided between the pedestal 30 and the rear of the seat 28 to provide a handle onto which a passenger may hold. This arrangement is particularly convenient for a passenger seated facing backwards for spotting a water skier, for example. Beneath the handle 38, a tow hook 40 is mounted on the pedestal 30. The tow hook 40 can be used for towing a skier or floatation device, such as an inflatable water toy.

As best seen in FIGS. 2 and 4 the watercraft 10 has a pair of generally upwardly extending walls located on either side of the watercraft 10 known as gunwales or gunnels 42. The gunnels 42 help to prevent the entry of water in the footrests 46 of the watercraft 10, provide lateral support for the rider's feet, and also provide buoyancy when turning the watercraft 10, since personal watercraft roll slightly when turning. Towards the rear of the watercraft 10, the gunnels 42 extend inwardly to act as heel rests 44. Heel rests 44 allow a passenger riding the watercraft 10 facing towards the rear, to spot a water-skier for example, to place his or her heels on the heel rests 44, thereby providing a more stable riding position. Heel rests 44 could also be formed separate from the gunnels 42.

Located on both sides of the watercraft 10, between the pedestal 30 and the gunnels 42 are the footrests 46. The footrests 46 are designed to accommodate a rider's feet in various riding positions. To this effect, the footrests 46 each have a forward portion 48 angled such that the front portion of the forward portion 48 (toward the bow 56 of the watercraft 10) is higher, relative to a horizontal reference point, than the rear portion of the forward portion 48. The remaining portions of the footrests 46 are generally horizontal. Of course, any contour conducive to a comfortable rest for the rider could be used. The footrests 46 are covered by carpeting 50 made of a rubber-type material, for example, to provide additional comfort and traction for the feet of the rider.

A reboarding platform 52 is provided at the rear of the watercraft 10 on the deck 14 to allow the rider or a passenger to easily reboard the watercraft 10 from the water. Carpeting or some other suitable covering covers the reboarding platform 52. A retractable ladder (not shown) may be affixed to the transom 54 to facilitate boarding the watercraft 10 from the water onto the reboarding platform 52.

Figure 3:
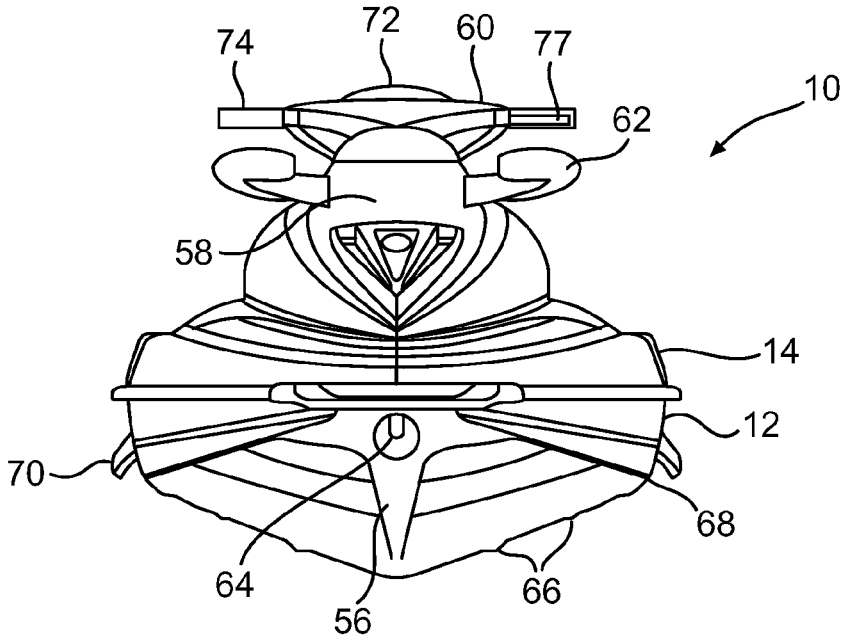
FIG. 3 is a front view of the watercraft of FIG. 1.

Referring to the bow 56 of the watercraft 10, as seen in FIGS. 2 and 3, watercraft 10 is provided with a hood 58 located forwardly of the seat 28 and a steering assembly including a helm assembly 60. A hinge (not shown) is attached between a forward portion of the hood 58 and the deck 14 to allow hood 58 to move to an open position to provide access to the front storage bin 24 (FIG. 1). A latch (not shown) located at a rearward portion of hood 58 locks hood 58 into a closed position. When in the closed position, hood 58 prevents water from entering front storage bin 24. Rearview mirrors 62 are positioned on either side of hood 58 to allow the rider to see behind the watercraft 10. A hook 64 is located at the bow 56 of the watercraft 10. The hook 64 is used to attach the watercraft 10 to a dock when the watercraft is not in use or to attach to a winch when loading the watercraft 10 on a trailer, for instance.

Figure 5:
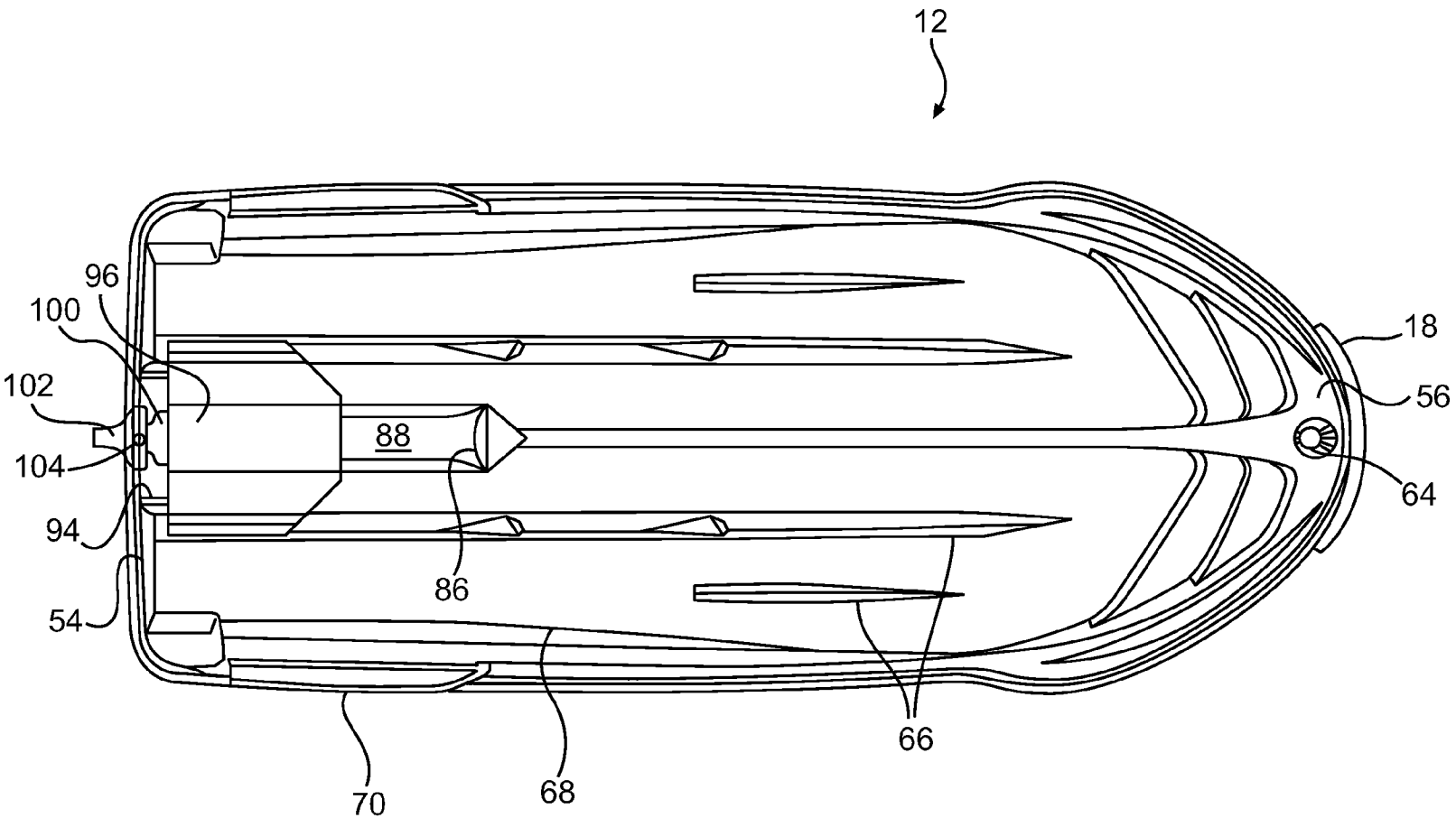
FIG. 5 is a bottom view of the hull of the watercraft of FIG. 1.

As best seen in FIGS. 3, 4, and 5, the hull 12 is provided with a combination of strakes 66 and chines 68. A strake 66 is a protruding portion of the hull 12. A chine 68 is the vertex formed where two surfaces of the hull 12 meet. The combination of strakes 66 and chines 68 provide the watercraft 10 with its riding and handling characteristics.

Sponsons 70 are located on both sides of the hull 12 near the transom 54. The sponsons 70 preferably have an arcuate undersurface that gives the watercraft 10 both lift while in motion and improved turning characteristics. The sponsons 70 are preferably fixed to the surface of the hull 12 and can be attached to the hull by fasteners or molded therewith. Sometimes it may be desirable to adjust the position of the sponson 70 with respect to the hull 12 to change the handling characteristics of the watercraft 10 and accommodate different riding conditions.

As best seen in FIGS. 3 and 4, the helm assembly 60 is positioned forwardly of the seat 28. The helm assembly 60 has a central helm portion 72, that may be padded, and a pair of steering handles 74, also referred to as a handlebar. One of the steering handles 74 is preferably provided with a throttle operator 76, which allows the rider to control the engine 22, and therefore the speed of the watercraft 10. The throttle operator 76 can be in the form of a thumb-actuated throttle lever (as shown), a finger-actuated throttle lever, or a twist grip. The throttle operator 76 is movable between an idle position and multiple actuated positions. The throttle operator 76 is preferably biased towards the idle position, such that when the driver of the watercraft lets go of the throttle operator 76, it will move to the idle position. The other of the steering handles 74 may be provided with a lever 77 used by the driver to control the jet propulsion system 84 as described in greater detail below.

As seen in FIG. 2, a display area or cluster 78 is located forwardly of the helm assembly 60. The display cluster 78 can be of any conventional display type, including a liquid crystal display (LCD), dials or LED (light emitting diodes). The central helm portion 72 has various buttons 80, which could alternatively be in the form of levers or switches, that allow the rider to modify the display data or mode (speed, engine rpm, time . . . ) on the display cluster 78. Buttons 80 may also used by the driver to control the jet propulsion system 84 as described in greater detail below.

The helm assembly 60 also has a key receiving post 82, preferably located near a center of the central helm portion 72. The key receiving post 82 is adapted to receive a key (not shown) that starts the watercraft 10. As is known, the key is typically attached to a safety lanyard (not shown). It should be noted that the key receiving post 82 may be placed in any suitable location on the watercraft 10.

Returning to FIGS. 1 and 5, the watercraft 10 is generally propelled by a jet propulsion system 84. As known, the jet propulsion system 84 pressurizes water to create thrust. The water is first scooped from under the hull 12 through an inlet 86, which preferably has a grate (not shown in detail). The inlet grate prevents large rocks, weeds, and other debris from entering the jet propulsion system 84, which may damage the system or negatively affect performance. Water flows from the inlet 86 through a water intake ramp 88. The top portion 90 of the water intake ramp 88 is formed by the hull 12, and a ride shoe (not shown in detail) forms its bottom portion 92. Alternatively, the intake ramp 88 may be a single piece or an insert to which the jet propulsion system 84 attaches. In such cases, the intake ramp 88 and the jet propulsion system 84 are attached as a unit in a recess in the bottom of hull 12.

Figure 8:
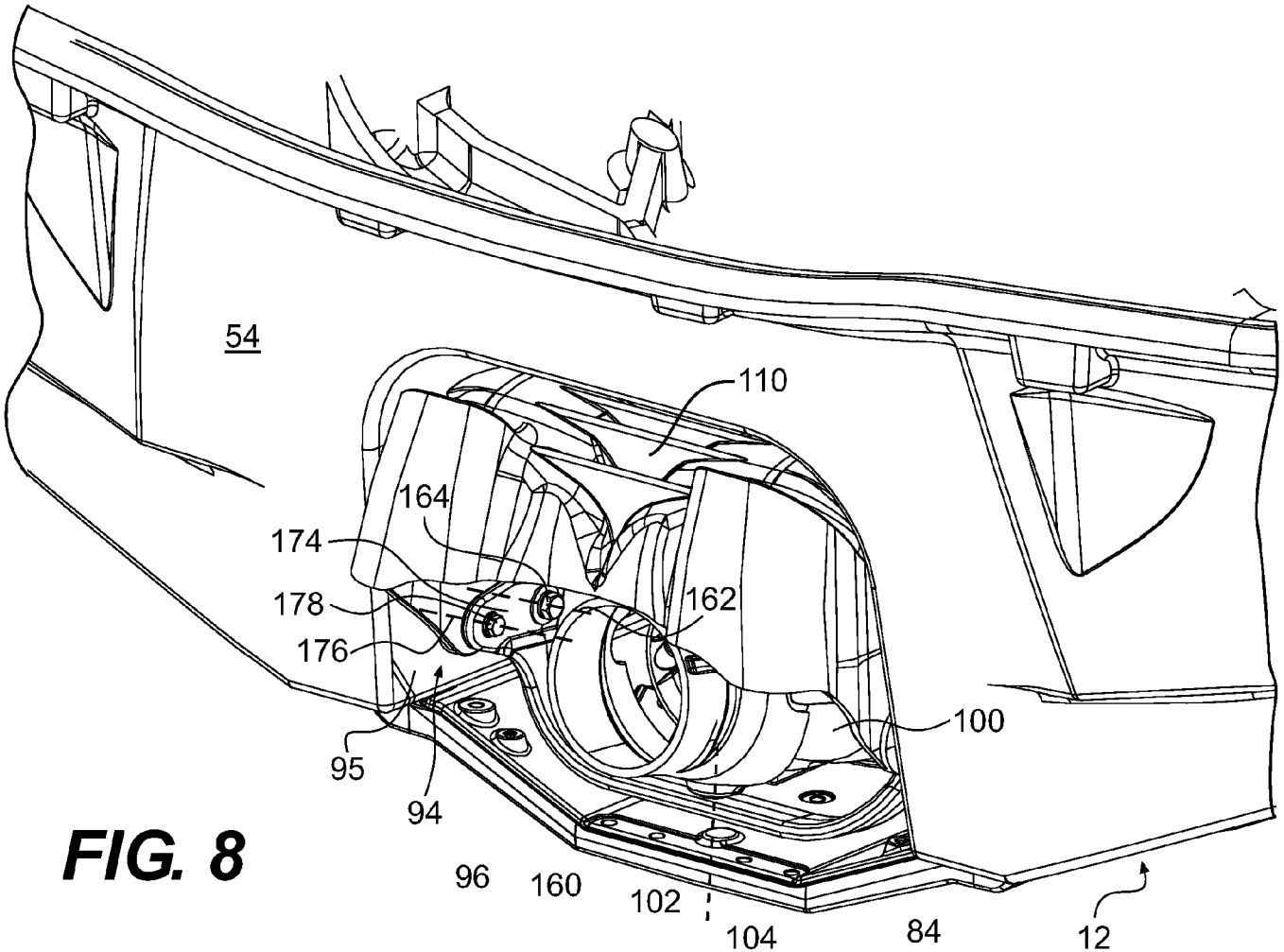
FIG. 8 is a perspective view, taken from a rear, right side, of a transom of the personal watercraft of FIG. 1.

From the intake ramp 88, water enters the jet propulsion system 84. As seen in FIG. 8, the jet propulsion system 84 is located in a formation in the hull 12, referred to as the tunnel 94. The tunnel 94 is defined at the front, sides, and top by walls 95 formed by the hull 12 (see FIG. 9) and is open at the transom 54. The bottom of the tunnel 94 is closed by a ride plate 96. The ride plate 96 creates a surface on which the watercraft 10 rides or planes at high speeds.

The jet propulsion system 84 includes a jet pump 99. The forward end of the jet pump 99 is connected to the front wall 95 of the tunnel 94. The jet pump includes an impeller (not shown) and a stator (not shown). The impeller is coupled to the engine 22 by one or more shafts 98, such as a driveshaft and an impeller shaft. The rotation of the impeller pressurizes the water, which then moves over the stator that is made of a plurality of fixed stator blades (not shown). The role of the stator blades is to decrease the rotational motion of the water so that almost all the energy given to the water is used for thrust, as opposed to swirling the water. Once the water leaves the jet pump 99, it goes through a venturi 100 that is connected to the rearward end of the jet pump 99. Since the venturi's exit diameter is smaller than its entrance diameter, the water is accelerated further, thereby providing more thrust. A steering nozzle 102 is rotationally mounted relative to the venturi 100, as described in greater detail below, so as to pivot about a steering axis 104.

The steering nozzle 102 is operatively connected to the helm assembly 60 preferably via a push-pull cable (not shown) such that when the helm assembly 60 is turned, the steering nozzle 102 pivots about the steering axis 104. This movement redirects the pressurized water coming from the venturi 100, so as to redirect the thrust and steer the watercraft 10 in the desired direction.

The jet propulsion system 84 is provided with a reverse gate 110 which is movable between a stowed position where it does not interfere with a jet of water being expelled by the steering nozzle 102 and a plurality of positions where it redirects the jet of water being expelled by the steering nozzle 102 as described in greater detail below. The specific construction of the reverse gate 110 will not be described in detail herein. However it will be understood by those skilled in the art that many different types of reverse gate could be provided without departing from the present invention. One example of a suitable reverse gate is described in U.S. Pat. No. 6,533,623, issued on Mar. 18, 2003, the entirety of which is incorporated herein by reference.

When the watercraft 10 is moving, its speed is measured by a speed sensor 106 attached to the transom 54 of the watercraft 10. The speed sensor 106 has a paddle wheel 108 that is turned by the water flowing past the hull 12. In operation, as the watercraft 10 goes faster, the paddle wheel 108 turns faster in correspondence. An electronic control unit (ECU) (not shown) connected to the speed sensor 106 converts the rotational speed of the paddle wheel 108 to the speed of the watercraft 10 in kilometers or miles per hour, depending on the rider's preference. The speed sensor 106 may also be placed in the ride plate 96 or at any other suitable position. Other types of speed sensors, such as pitot tubes, and processing units could be used, as would be readily recognized by one of ordinary skill in the art. Alternatively, a global positioning system (GPS) unit could be used to determine the speed of the watercraft 10 by calculating the change in position of the watercraft 10 over a period of time based on information obtained from the GPS unit.

Figure 6:
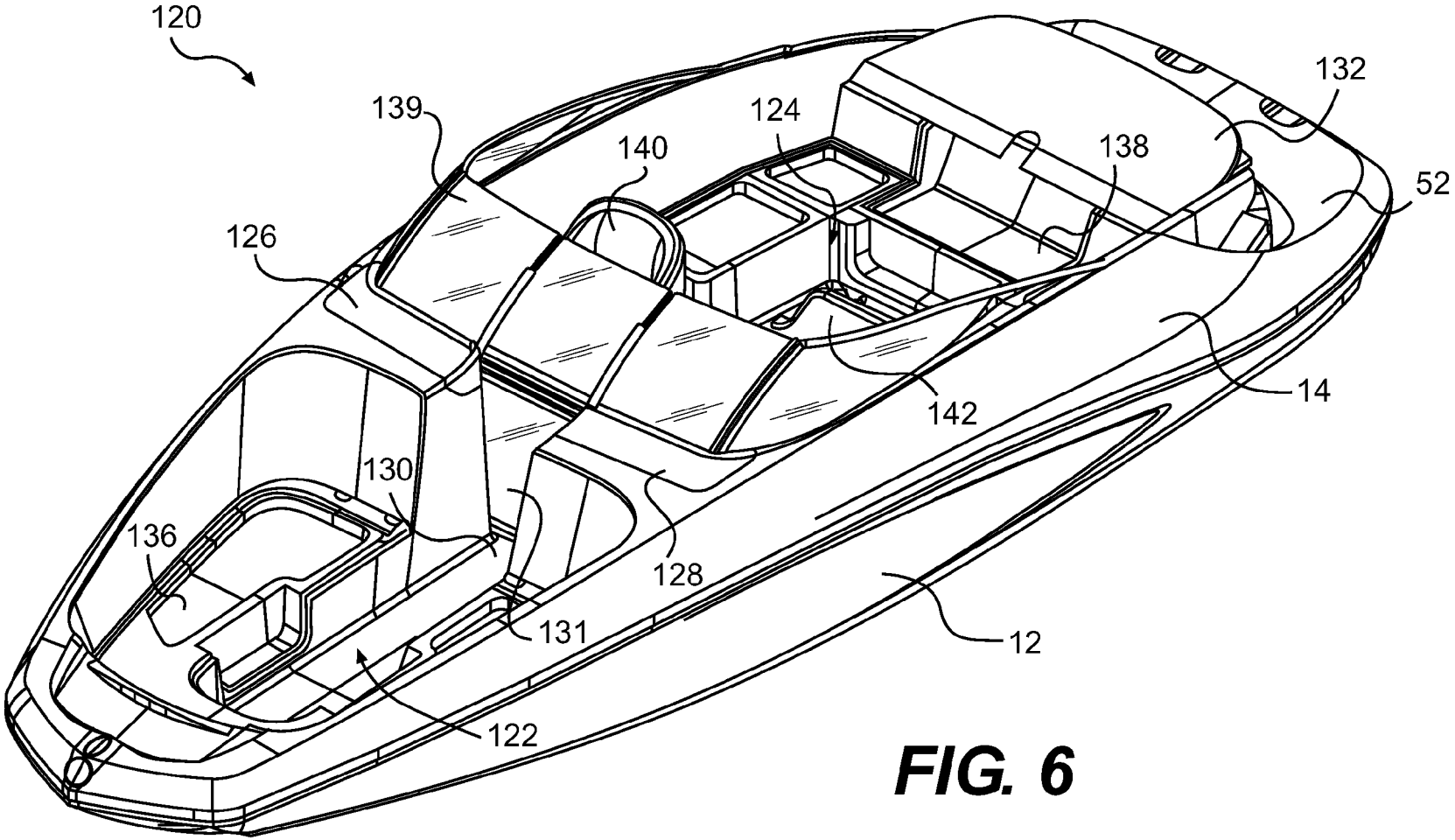
FIG. 6 is a perspective view, taken from a front, left side, of a jet boat in accordance with the invention.
Figure 7:
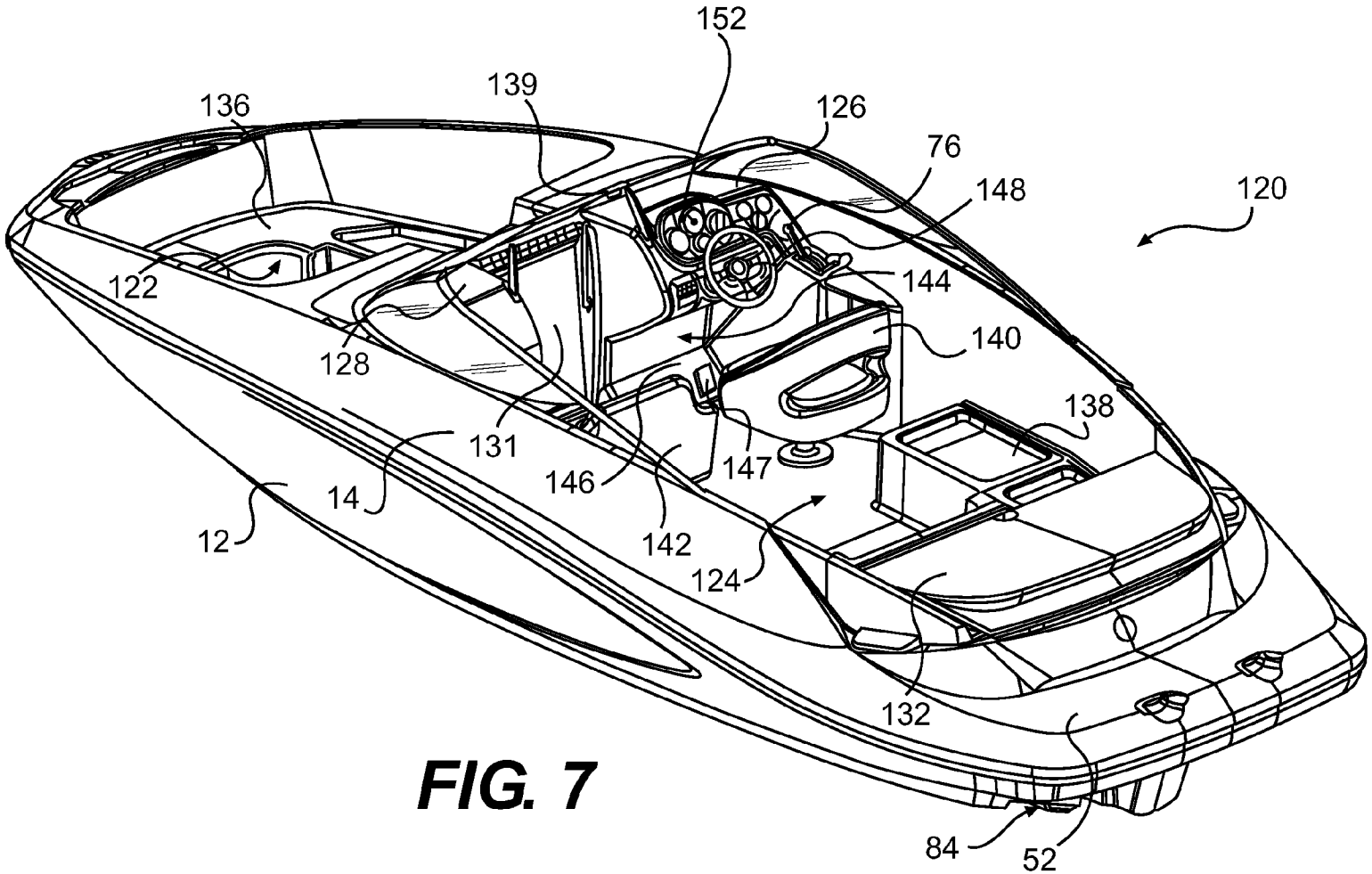
FIG. 7 is a perspective view, taken from a rear, left side, of the jet boat of FIG. 6.

The general construction of a jet boat 120 in accordance with this invention will now be described with respect to FIGS. 6 and 7. The following description relates to one way of manufacturing a jet boat. Obviously, those of ordinary skill in the jet boat art will recognize that there are other known ways of manufacturing and designing jet boats and that this invention would encompass other known ways and designs.

For simplicity, the components of the jet boat 120 which are similar in nature to the components of the personal watercraft 10 described above will be given the same reference numeral. It should be understood that their specific construction may vary however.

The jet boat 120 has a hull 12 and a deck 14 supported by the hull 12. The deck 14 has a forward passenger area 122 and a rearward passenger area 124. A right console 126 and a left console 128 are disposed on either side of the deck 14 between the two passenger areas 122, 124. A passageway 130 disposed between the two consoles 126, 128 allows for communication between the two passenger areas 122, 124. A door 131 is used to selectively open and close the passageway 130. At least one engine (not shown) is located between the hull 12 and the deck 14 at the back of the boat 120. The engine powers jet propulsion system 84 of the boat 120. The jet propulsion system 84 is of similar construction as the jet propulsion system 84 of the personal watercraft 10 described above, and in greater detail below, and will therefore not be described in detail here. It is contemplated that the boat 120 could have two engines and two jet propulsion systems 84. The engine is accessible through an engine cover 132 located behind the rearward passenger area 124. The engine cover 132 can also be used as a sundeck for a passenger of the boat 120 to sunbathe on while the boat 120 is not in motion. A reboarding platform 52 is located at the back of the deck 14 for passengers to easily reboard the boat 120 from the water.

The forward passenger area 122 has a C-shaped seating area 136 for passengers to sit on. The rearward passenger area 124 also has a C-shaped seating area 138 at the back thereof. A driver seat 140 facing the right console 126 and a passenger seat 142 facing the left console 124 are also disposed in the rearward passenger area 124. It is contemplated that the driver and passenger seats 140, 142 can swivel so that the passengers occupying these seats can socialize with passengers occupying the C-shaped seating area 138. A windshield 139 is provided at least partially on the left and right consoles 124, 126 and forwardly of the rearward passenger area 124 to shield the passengers sitting in that area from the wind when the boat 120 is in movement. The right and left consoles 126, 128 extend inwardly from their respective side of the boat 120. At least a portion of each of the right and the left consoles 126, 128 is integrally formed with the deck 14. The right console 126 has a recess 144 formed on the lower portion of the back thereof to accommodate the feet of the driver sitting in the driver seat 140 and an angled portion of the right console 126 acts as a footrest 146. A foot pedal 147 is provided on the footrest 146 which may be used to control the jet propulsion system 84 as described in greater detail below. The left console 128 has a similar recess (not shown) to accommodate the feet of the passenger sitting in the passenger seat 142. The right console 126 accommodates all of the elements necessary to the driver to operate the boat 120. These include, but are not limited to, a steering assembly including a steering wheel 148, a throttle operator 76 in the form of a throttle lever, and an instrument panel 152. The instrument panel 152 has various dials indicating the watercraft speed, engine speed, fuel and oil level, and engine temperature. The speed of the watercraft is measured by a speed sensor (not shown) which can be in the form of the speed sensor 106 described above with respect to the personal watercraft 10 or a GPS unit or any other type of speed sensor which could be used for marine applications. It is contemplated that the elements attached to the right console 126 could be different than those mentioned above. The left console 128 incorporates a storage compartment (not shown) which is accessible to the passenger sitting the passenger seat 142.

Turning now to FIGS. 8 to 20 a first embodiment of the jet propulsion system 84 will be described. As seen in FIG. 8, the jet propulsion system 84 is disposed in a tunnel 94 of the watercraft 10. It is contemplated that the jet propulsion system 84 could be mounted directly to the transom 54.

Figure 12:
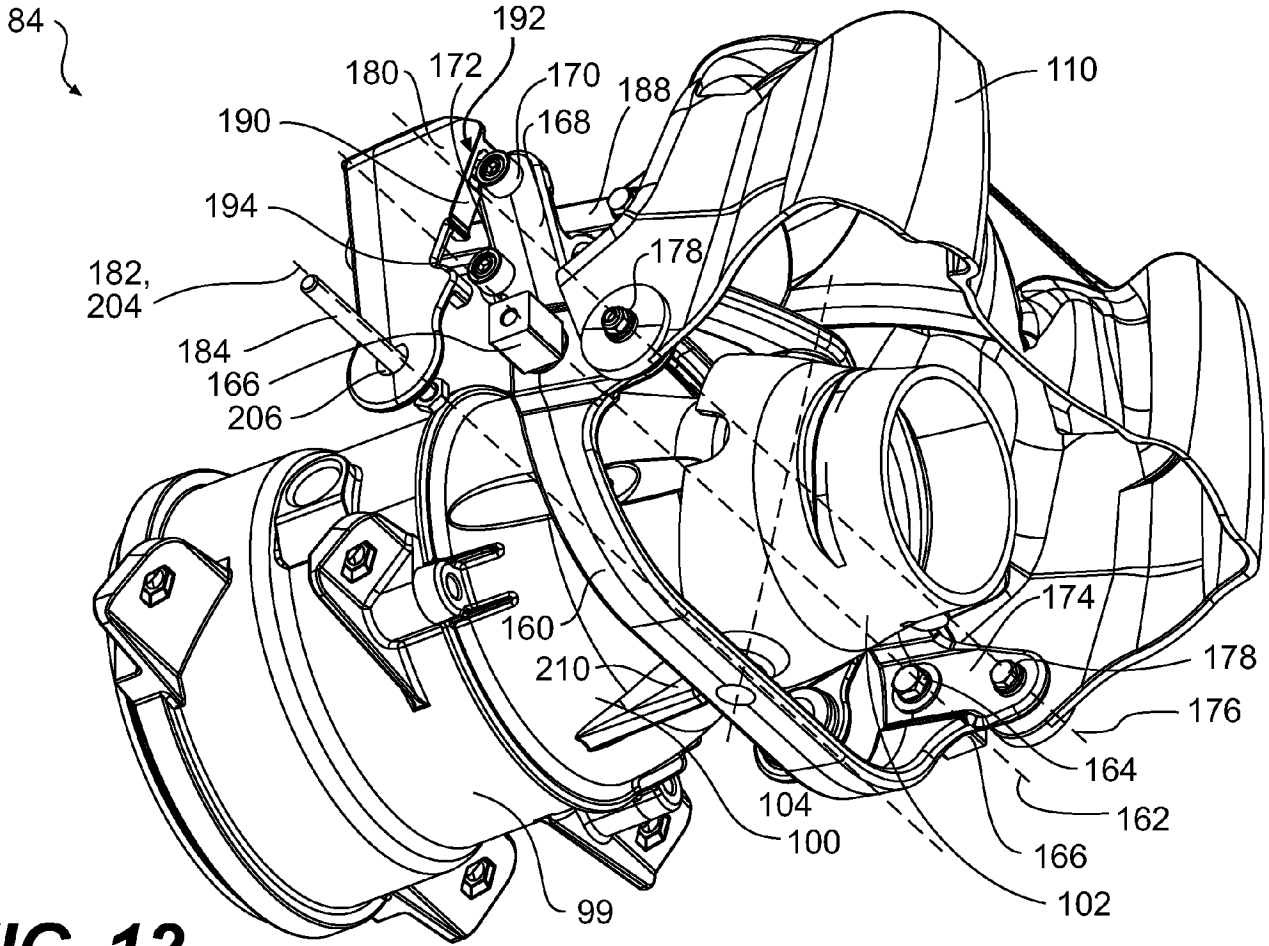
FIG. 12 is a bottom perspective view, taken from a rear, left side, of the jet propulsion system of FIG. 10 with the reverse gate in the stowed position.
Figure 13:
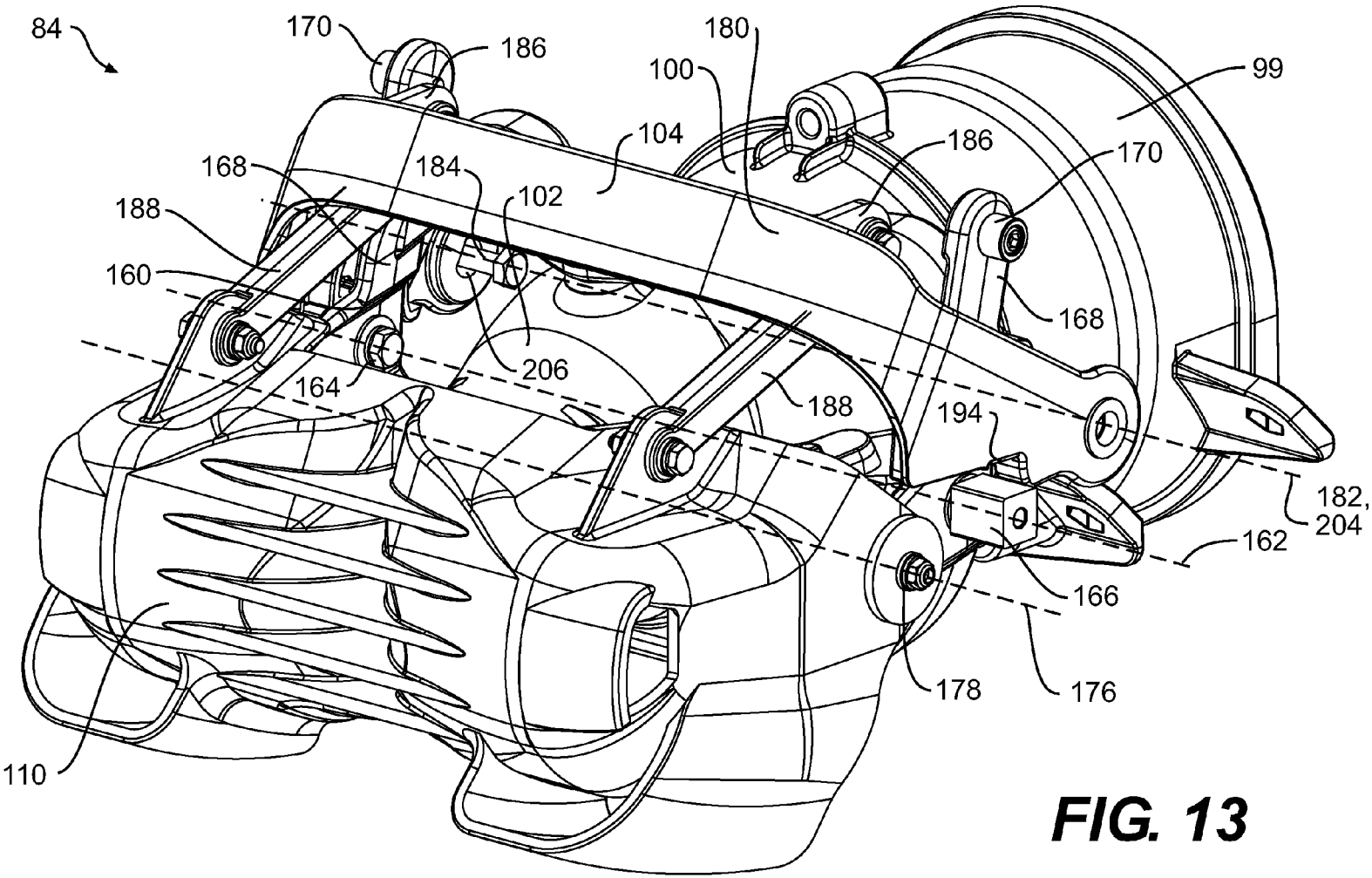
FIG. 13 is a perspective view, taken from a rear right side, of the jet propulsion system of FIG. 10 with the reverse gate in a fully lowered position.

As previously mentioned, the jet propulsion assembly 84 includes a jet pump 99, a venturi 100, a steering nozzle 102, and a reverse gate 110. A variable trim system (VTS) support 160 is rotationally mounted to two side plates 161 (FIG. 11) which are mounted to the two side walls 95 of the tunnel 94 (see FIG. 8) about a VTS axis 162. The VTS axis 162 extends generally laterally and horizontally. Bolts 164 are used to connect the VTS support 160 to the side plates 161. Spacer blocks 166 are provided between the VTS support 160 and the side plates 161 to prevent the VTS support 160 from moving laterally inside the tunnel 94. The right side plate 161 has an exhaust connector 163 which connects to the exhaust system (not shown) of the watercraft to allow the exhaust gases to be exhausted inside the tunnel 94. It is contemplated that the VTS support 160 could be rotationally mounted about the VTS axis 162 directly on the venturi 100. As best seen in FIG. 12, the VTS support 160 is in the shape of a ring which encircles the forward portion of the steering nozzle 102. The steering nozzle 102 is rotationally mounted at a top and bottom of the VTS support 160 about the steering axis 104 such that the steering nozzle 102 rotates with the VTS support 160 about the VTS axis 162 as described below. The steering axis 104 is generally perpendicular to the VTS axis 162. As seen in FIGS. 10 to 20, the VTS support 160 has a pair of upwardly extending arms 168. A first guide pin 170 is disposed on each of the arms 168 at a position vertically higher than the VTS axis 162. A second guide pin 172 is disposed on each of the arms 168 at a position vertically higher than the VTS axis 162 and vertically lower than the first guide pin 170. The function of guide pins 170, 172 will be described below. The VTS support 160 also has a pair of rearwardly extending arms 174 to which the reverse gate 110 is rotationally mounted about a reverse gate axis 176 by nuts and bolts 178. The reverse gate axis 176 extends generally laterally and horizontally, and is disposed rearwardly of the VTS axis 162.

Figure 10:
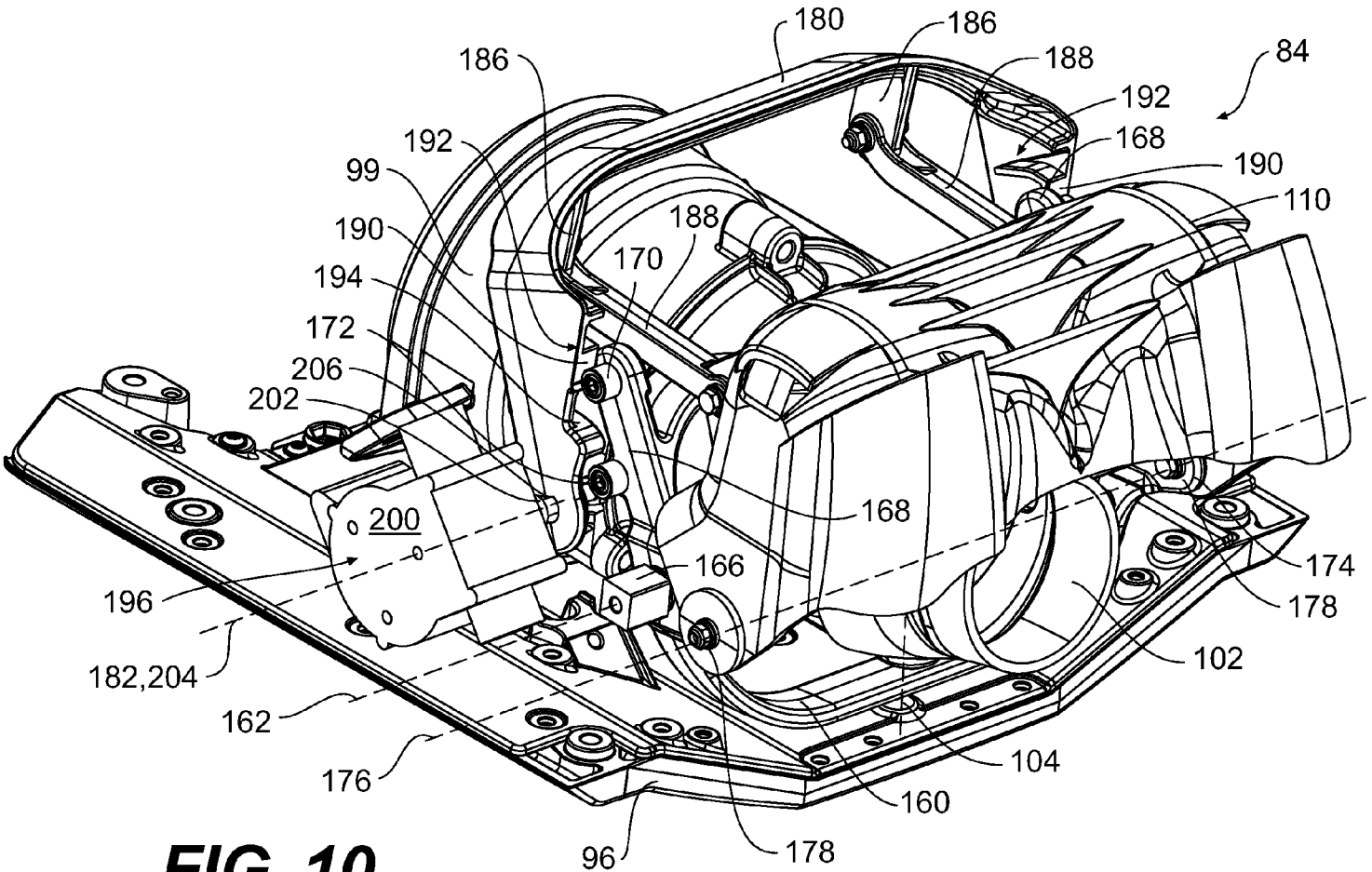
FIG. 10 is a perspective view, taken from a rear, left side, of a first embodiment of a jet propulsion system in accordance with the present invention with a reverse gate in a stowed position.
Figure 11:
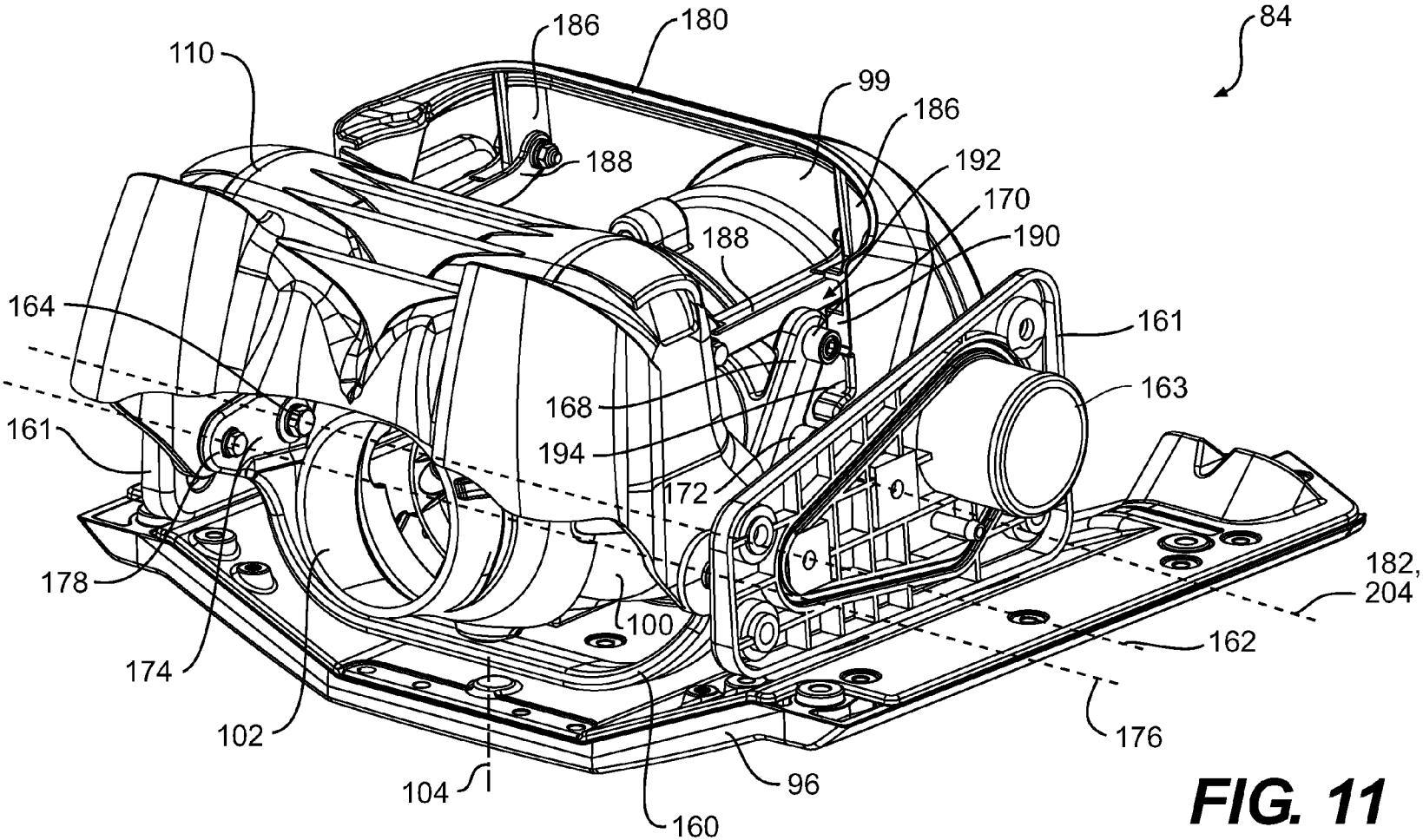
FIG. 11 is a perspective view, taken from a rear, right side, of the jet propulsion system of FIG. 10 with the reverse gate in the stowed position.

The jet propulsion system 84 is also provided with a main support 180 that is rotationally mounted to the two side plates 161 (FIG. 11) about a main support axis 182. The main support axis 182 extends generally laterally and horizontally. Bolts 184 (FIG. 12) are used to connect the main support 180 to the right side plate 161 and to the rotary actuator 196 (described below). The main support axis 182 is disposed forwardly of the VTS axis 162. It is contemplated that the main support 180 could be rotationally mounted about the main support axis 182 directly on the jet pump 99 or venturi 100. The main support 180 has an inverted U-shape. The upper portion of the main support 180 has a pair of downwardly extending tabs 186. Each tab 186 is pivotally connected to a first portion of a link 188 with a nut and a bolt. The second, opposite, portion of each link 188 is pivotally connected to the reverse gate 110 at a point vertically higher than the reverse gate axis 176 with a nut and a bolt. It is contemplated that only one or more than two tabs 186 and links 188 could be used. As best seen in FIG. 10, the main support 180 defines contact surfaces 190 on a rearwardly facing side thereof. As described in greater detail below, the first guide pins 170 contact the contact surfaces 190 in at least some arrangements of the VTS support 160 and the main support 180. As seen in FIGS. 10 and 17 to 20, the main support 180 also defines slots 192 therein which have an opening at an upper end of the contact surfaces 190. As described in greater detail below, the first guide pins 170 are disposed in the slots 192 in at least some arrangements of the VTS support 160 and the main support 180. As also seen in FIGS. 10 and 17 to 20, the main support 180 also defines ramps 194 which are disposed vertically below the slots 192 when the main support 180 is in the position shown in FIG. 17. The ramps 194 have an arcuate surface corresponding to a segment of a circle having the main support axis 182 as a center. As described in greater detail below, the second guide pins 172 contact the arcuate surfaces of the ramps 194 in at least some arrangements of the VTS support 160 and the main support 180.

Figure 9:
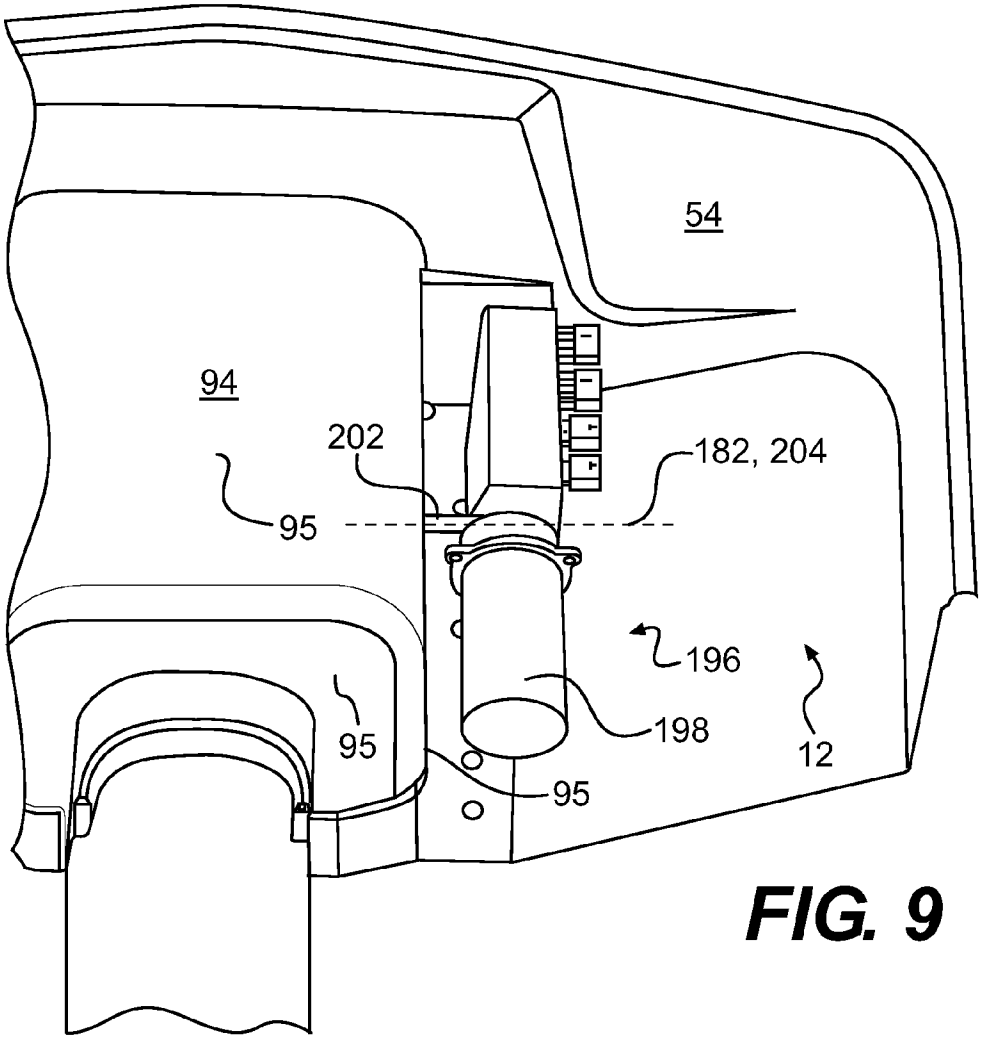
FIG. 9 is a top perspective view of a rear portion of the hull of the personal watercraft of FIG. 1.

As seen in FIGS. 9 and 10, the jet propulsion system 84 is provided with a rotary actuator 196 disposed inside the hull 12 adjacent the left side wall 95 of the tunnel 94, thus limiting the exposure of the actuator 196 to water. The rotary actuator 196 includes a rotary electric motor 198 connected to a gear box 200 having an output portion 202. The gear box 200 transfers the rotation from an output shaft (not shown) of the rotary electric motor 198 to the output portion 202 which is perpendicular to the output shaft. It is contemplated that a power screw could be used to transfer the rotation from the output shaft of the rotary electric motor 198 to the output portion 202. The output portion 202 passes through the left side wall 95 and left side plate 161 and connects to the main support 180 so as to rotate the main support 180 about the main support axis 182 as described in greater detail below. The axis of rotation 204 of the output portion 202 is coaxial with the main support axis 182. The end of the output portion 202 has a flat part and fits inside a hole 206 in the main support 180 having a corresponding flat part so as to prevent relative rotation between the output portion 202 and the main support 180. It is contemplated that other ways of preventing relative rotation between the output portion 202 and the main support 180 could be used. It is also contemplated that other types of actuators could be used, such as, for example, an hydraulic actuator. The rotary actuator 196 is controlled based on signals received from one or more of the lever 77, and buttons 80 for the personal watercraft 10, and from one or more of the pedal 147, buttons (not shown), and lever (not shown) for the boat 120, or from a steering position sensor (not shown) so as to provide the VTS position and reverse gate position desired by the driver of the watercraft. It is contemplated that the rotary actuator 196 could be automatically controlled without any driver intervention based on conditions of the watercraft and engine such as vehicle speed and engine speed so as to provide the most appropriate VTS position and reverse gate position. It is also contemplated that a combination of automatic control and driver input could be used to control the rotary actuator 196. For example, the VTS position and some reverse gate positions could be automatically controlled, but the driver (through a lever, button, or pedal) would provide the input to the rotary actuator 196 that a reverse operation of the watercraft is desired.

Turning now to FIGS. 14 to 20, the operation of the jet propulsion system 84, and more specifically the movement of the main support 180, VTS support 160, steering nozzle 102, and reverse gate 110, will be described. It should be understood that FIGS. 14 to 20 only show some of the arrangements of these components and that arrangements intermediate those shown are possible. For simplicity, the description will be made only with respect to the left side of the jet propulsion system 84. Although not specifically shown in these figures, it should also be understood that a position of the output portion 202 of the rotary actuator 196 corresponds to a position of the main support 180. As such, when the main support 180 is shown as having been rotated by a certain number of degrees in one direction from one position to another, it should be understood that this rotation was caused by the output portion 202 rotating by the same number of degrees in the same direction.

Figure 14:
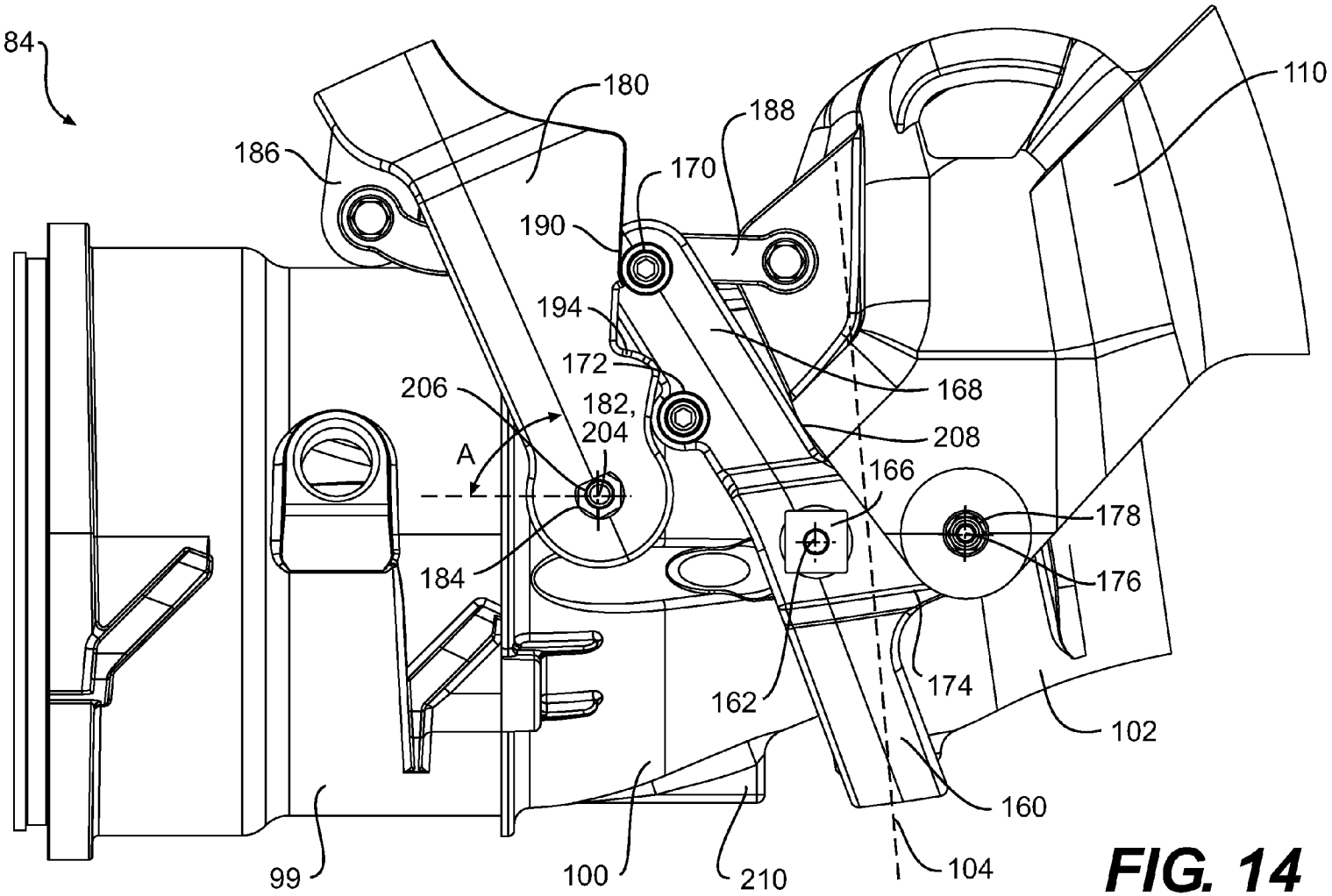
FIG. 14 is a left side view of the jet propulsion system of FIG. 10 with the variable trim system (VTS) in a VTS up position and the reverse gate in a stowed position.

In the arrangement shown in FIG. 14, the main support 180 is in a first position that is an angle A from horizontal. The VTS support 160 is in a VTS up position where the steering nozzle 102 directs a jet of water from the venturi 100 slightly upwardly. The reverse gate 110 is in a stowed position (i.e. a position where it does not interfere with the jet of water coming from the steering nozzle 102). Unless the main support 180 is rotated by the output portion 202, the VTS support 160 is prevented from rotating counter-clockwise since the first guide pin 170 contacts the contact surface 190 and is prevented from rotating clockwise since the reverse gate 110 contacts a contact point 208 located vertically higher than the VTS axis 162 on the arm 168 of the VTS support 160. The reverse gate 110 is prevented from rotating clockwise by link 188.

Figure 15:
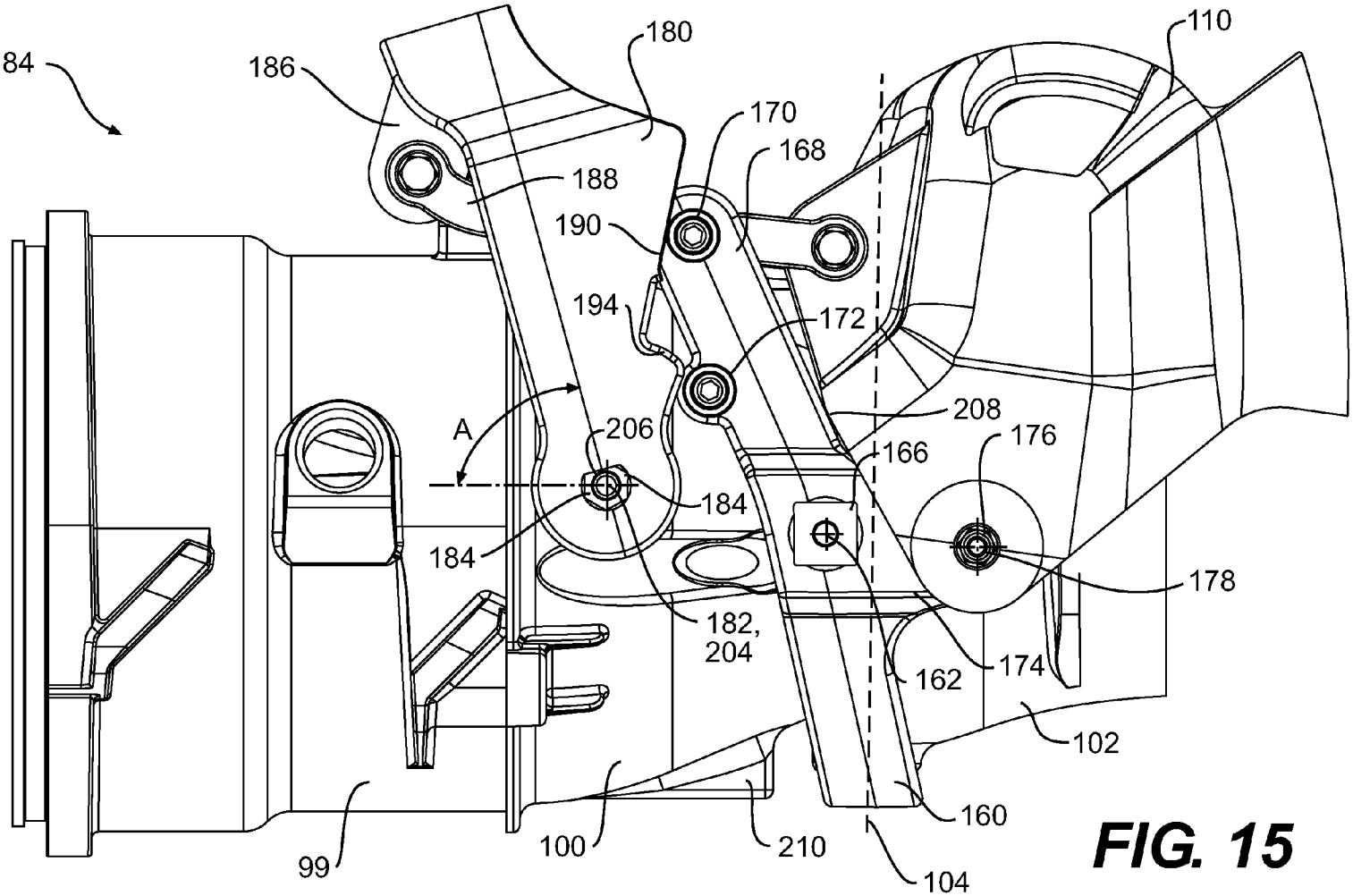
FIG. 15 is a left side view of the jet propulsion system of FIG. 10 with the VTS in a VTS neutral position and the reverse gate in a stowed position.
Figure 16:
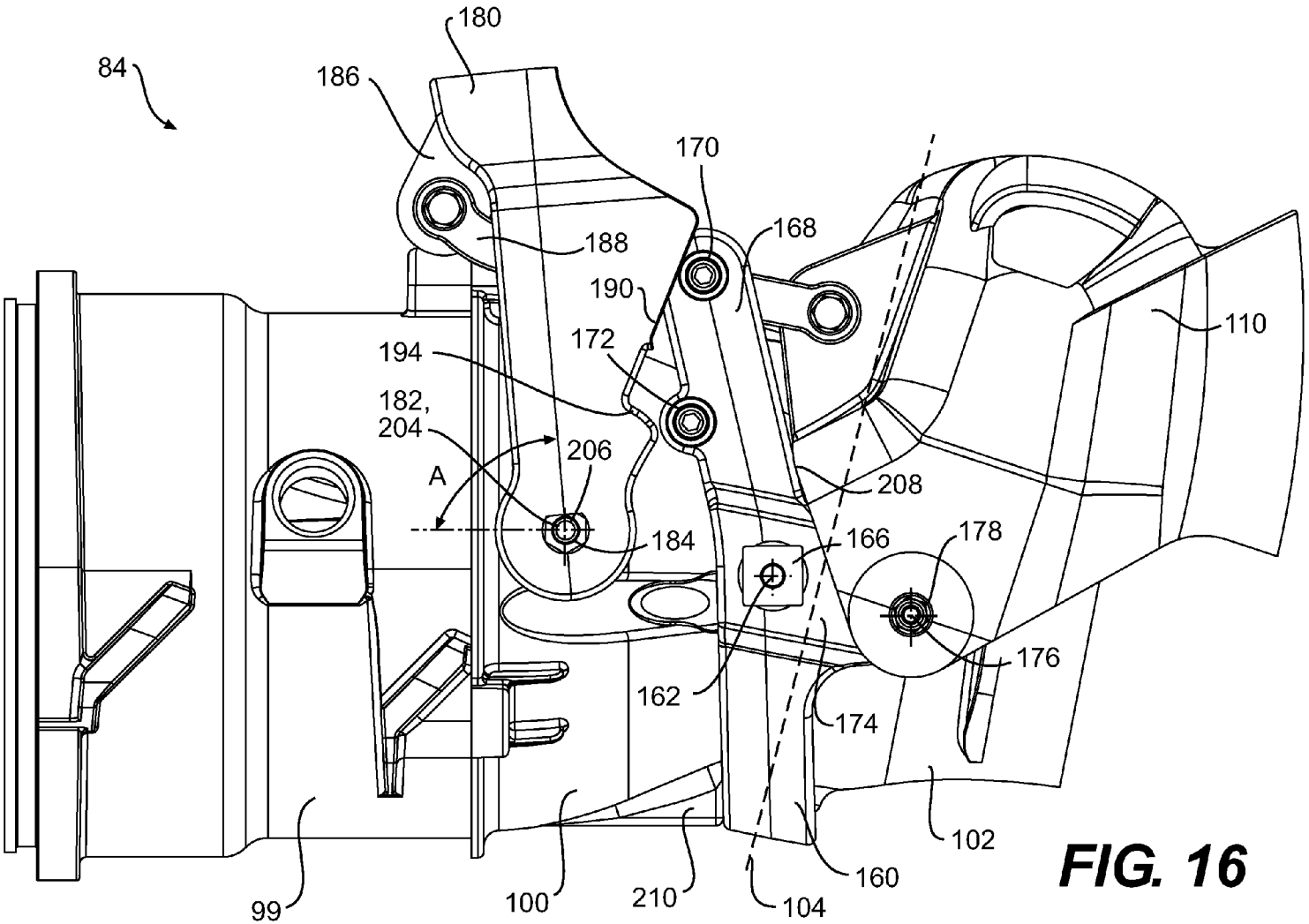
FIG. 16 is a left side view of the jet propulsion system of FIG. 10 with the VTS in a VTS down position and the reverse gate in a stowed position.
Figure 17:
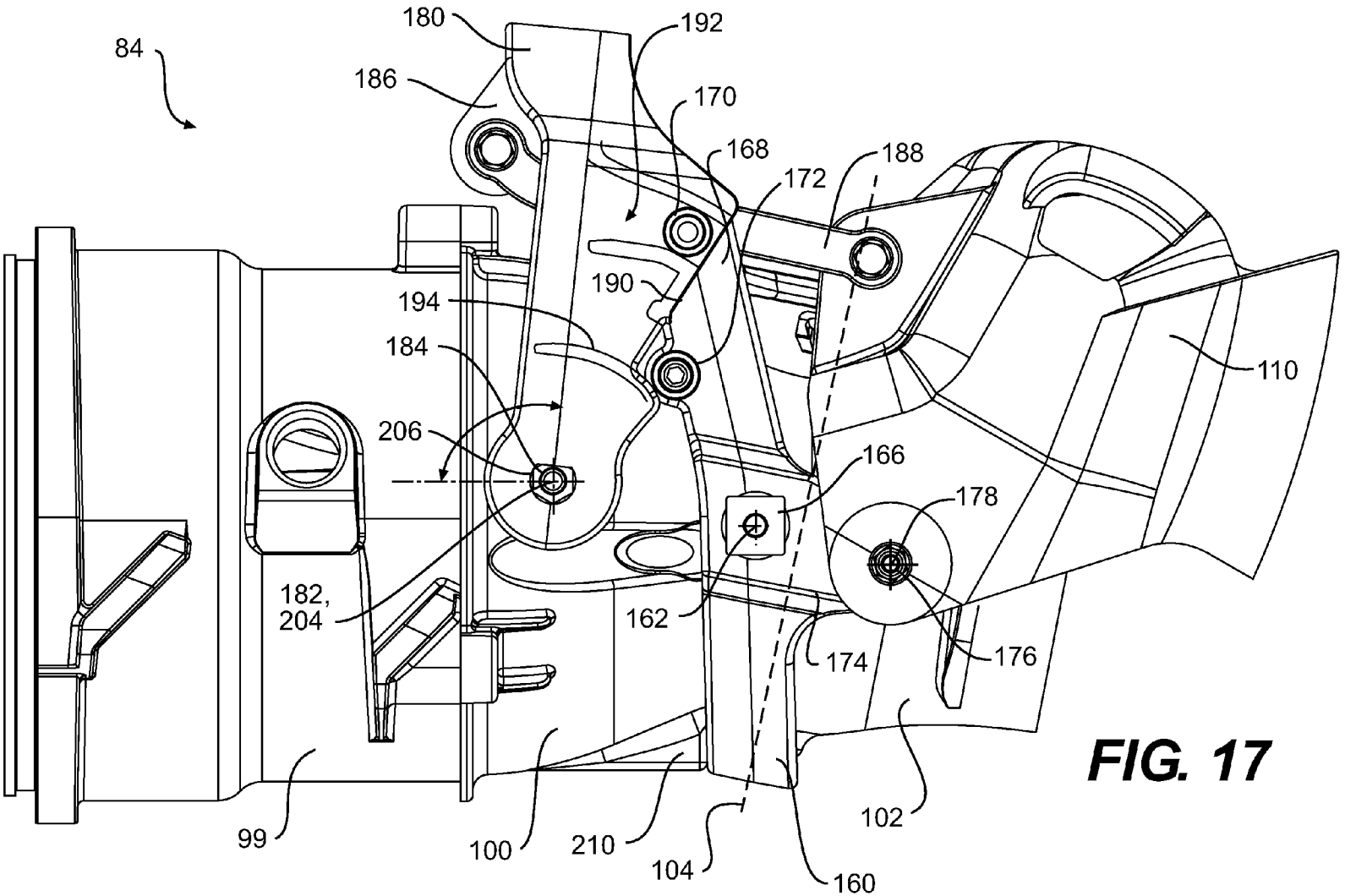
FIG. 17 is a left side view of the jet propulsion system of FIG. 10 with the VTS in a VTS down position and the reverse gate in a first lowered position.
Figure 18:
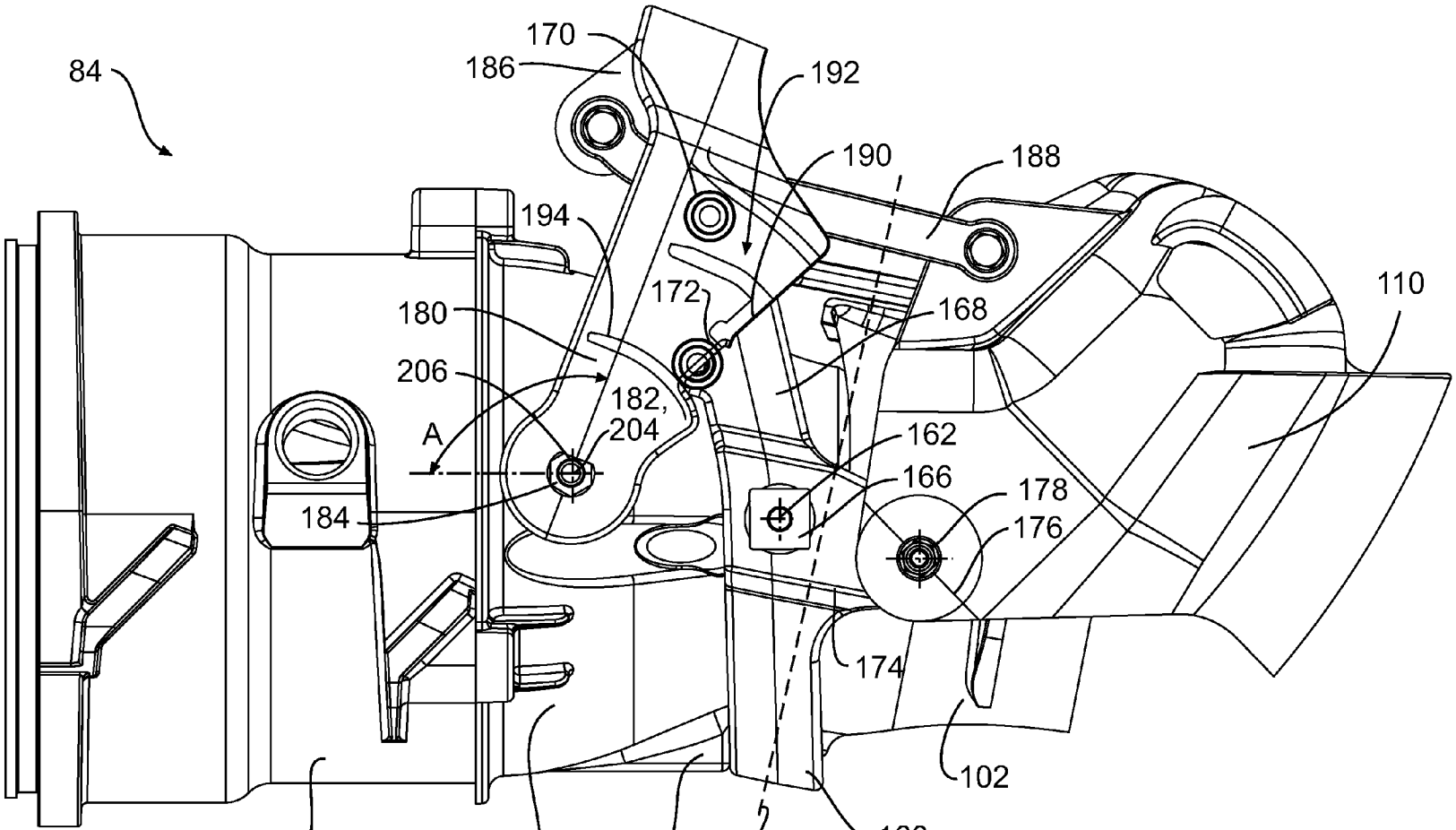
FIG. 18 is a left side view of the jet propulsion system of FIG. 10 with the VTS in a VTS down position and the reverse gate in a second lowered position.
Figure 19:
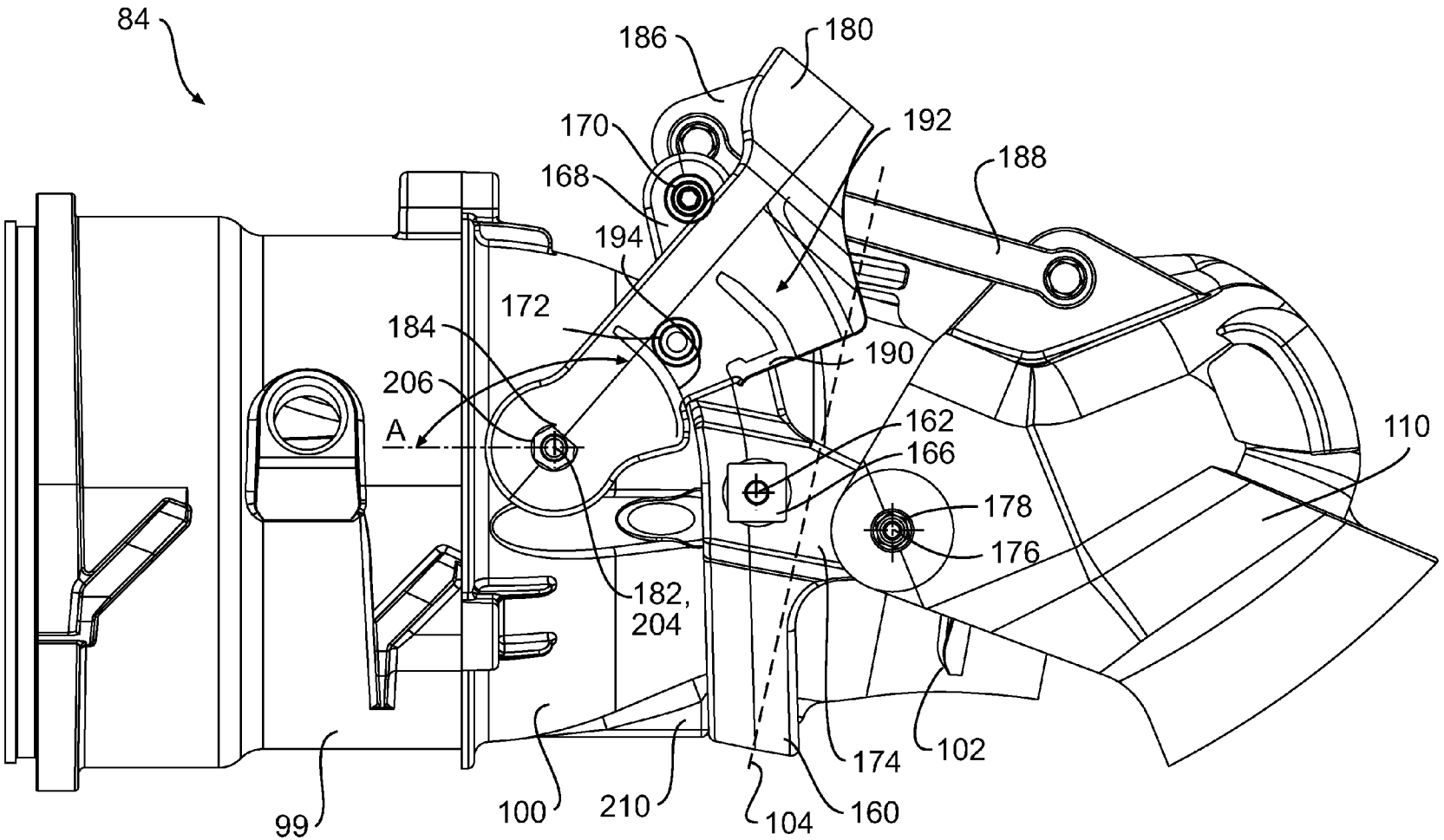
FIG. 19 is a left side view of the jet propulsion system of FIG. 10 with the VTS in a VTS down position and the reverse gate in a third lowered position.

As the output portion 202 is rotated clockwise, the main support 180 also rotates clockwise about the main support axis 182 from the position shown in FIG. 14 to the position shown in FIG. 15, and then to the position shown in FIG. 16, and as such the angle A increases. As the main support 180 rotates, the guide pin 170 slides upwardly along the contact surface 190, causing the VTS support 160 to rotate clockwise about the VTS axis 162. As the VTS support 160 rotates clockwise from the position shown in FIG. 14 to the position shown in FIG. 16, the reverse gate axis 176, and therefore the reverse gate 110, moves in an arc about the VTS axis 162. As such, the position of the reverse gate 110 relative to the VTS support 160 remains substantially the same (i.e. the stowed position) and the reverse gate 110 continues to contact the contact point 208. Therefore, for each position of the main support 180 between the position shown in FIG. 14 and the position shown in FIG. 16 there is a single corresponding position of the VTS support 160 since the VTS support is held between the contact surface 190 (by first guide pin 170) and the reverse gate 110. In the arrangement shown in FIG. 15, the VTS support 160 is in a VTS neutral position where the steering nozzle 102 directs a jet of water from the venturi 100 generally horizontally, and the reverse gate 110 is in the stowed position. In the arrangement shown in FIG. 16, the VTS support 160 is in a VTS down position where the steering nozzle 102 directs a jet of water from the venturi 100 slightly downwardly, and the reverse gate 110 is in a stowed position.

As the output portion 202 continues to be rotated clockwise, the main support 180 also continues to rotate clockwise about the main support axis 182 from the position shown in FIG. 16 to the positions shown in FIG. 17 to 20 consecutively, and as such the angle A continues to increase. Since, as shown in FIG. 16 to 20, the bottom portion of the VTS support 160 contacts a stopper portion 210 of the venturi 100, to permit the continued rotation of the main support 180 the first guide pin 170 enters slot 192. The VTS support 160 is maintained in the VTS down position in the arrangements shown in FIG. 17 to 20 by having the second guide pin 172 contact the arcuate surface of the ramp 194, thus preventing counter-clockwise rotation of the VTS support 160 about the VTS axis 162, which would otherwise occur due to the force of the water jet on the steering nozzle 102. Since the VTS support 160 is maintained in the VTS down position, the reverse gate axis 176 remains in position. Therefore, as the main support 180 is rotated clockwise, the link 188 pushes on the reverse gate 110 which no longer contacts the contact point 208 and rotates about the reverse gate axis 176 to the positions shown in FIGS. 17 to 20 consecutively. In the positions shown in these figures, the reverse gate 110 redirects the jet of water expelled from the steering nozzle 102. In the position shown in FIG. 18, the jet of water is redirected generally downwardly and as such the jet of water does not thrust the watercraft forward or backward. In the position shown in FIG. 20, most of the jet of water is redirected towards a front of the watercraft which causes the watercraft to move in the reverse direction.

In summary, as the output portion 202 of the rotary actuator 196 rotates the main support 180 from the position shown in FIG. 14 to the position shown in FIG. 16, the VTS support 160 rotates from the VTS up position to the VTS down position, while the reverse gate 110 remains in the stowed position. As the output portion 202 of the rotary actuator 196 continues to rotate the main support 180 from the position shown in FIG. 16 to the position shown in FIG. 20, the reverse gate 110 rotates about the reverse gate axis 176 to redirect the jet of water being expelled from the steering nozzle 102, while the VTS support 160 remains in the VTS down position.

Figure 20:
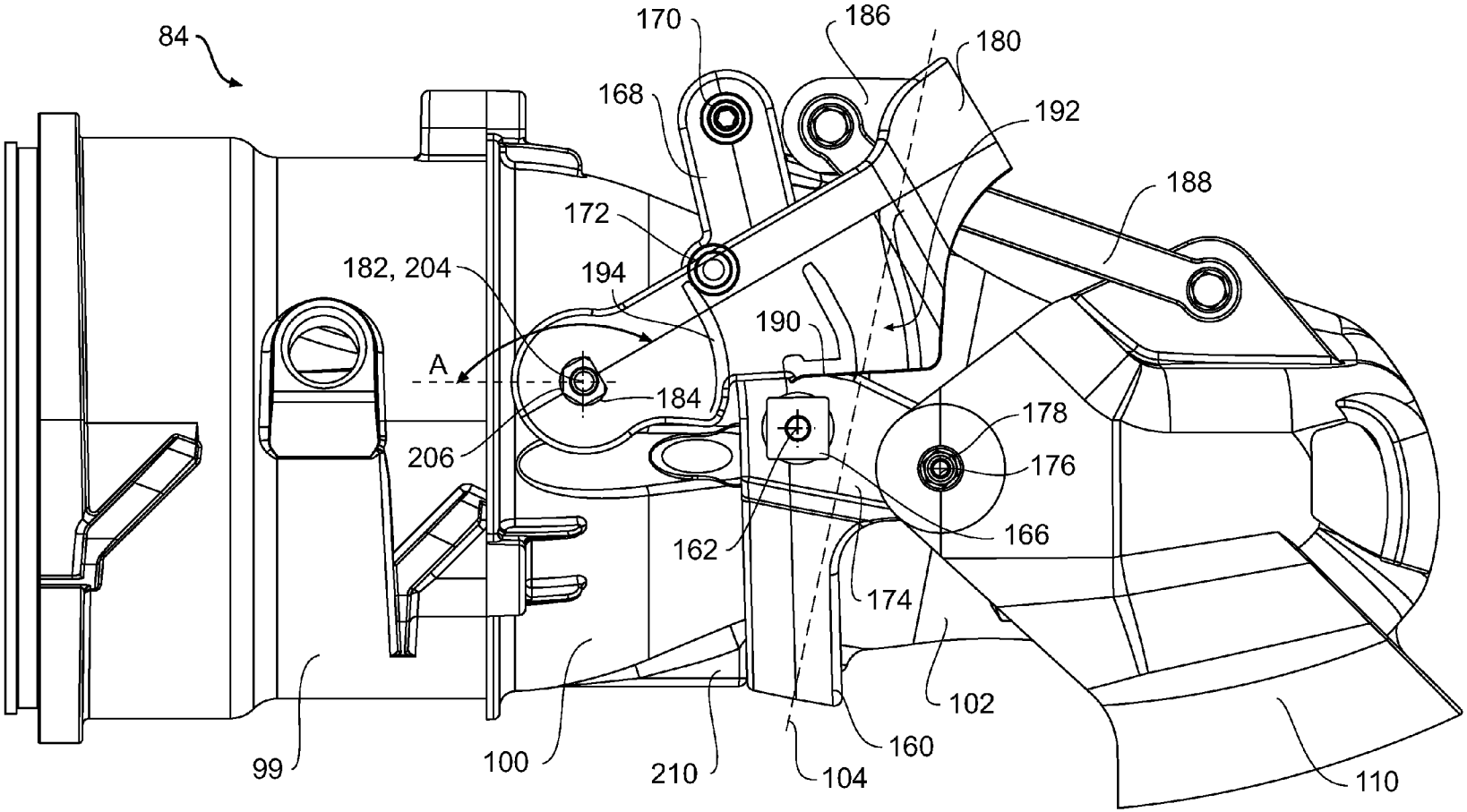
FIG. 20 is a left side view of the jet propulsion system of FIG. 10 with the VTS in a VTS down position and the reverse gate in a fully lowered position.

From FIG. 20, when the output portion 202 rotates counter-clockwise, the main support 180 rotates counter-clockwise, the link 188 pulls on the reverse gate 110 causing it to rotate counter-clockwise about the reverse gate axis 176, and the VTS support 106 remains fixed in the VTS down position until the position shown in FIG. 16. As the output portion 202 continues to rotate counter-clockwise from the position shown in FIG. 16, the reverse gate 110 contacts the contact point 208 and continues to be pulled by the link 188 causing the VTS support 160 to rotate counter-clockwise about the VTS axis 162, and the reverse gate 110 remains in the stowed position relative to the steering nozzle 102. It should be understood that the direction of rotation of the output portion 202 can be changed at any time (i.e. it does not need to be rotated from the position shown in FIG. 14 to the position shown in FIG. 20 before it can be rotated counter-clockwise, and vice versa). It should also be understood that the rotation of the output portion 202 can be stopped at any time to maintain a desired arrangement of the components.

It is contemplated that the rotary actuator 196 could be operatively connected to the VTS support 160 and the reverse gate 110 via components other than the main support 180 and still operate as described above. For example, it is contemplated that a system of cams and/or gears could be used.

Figure 21:
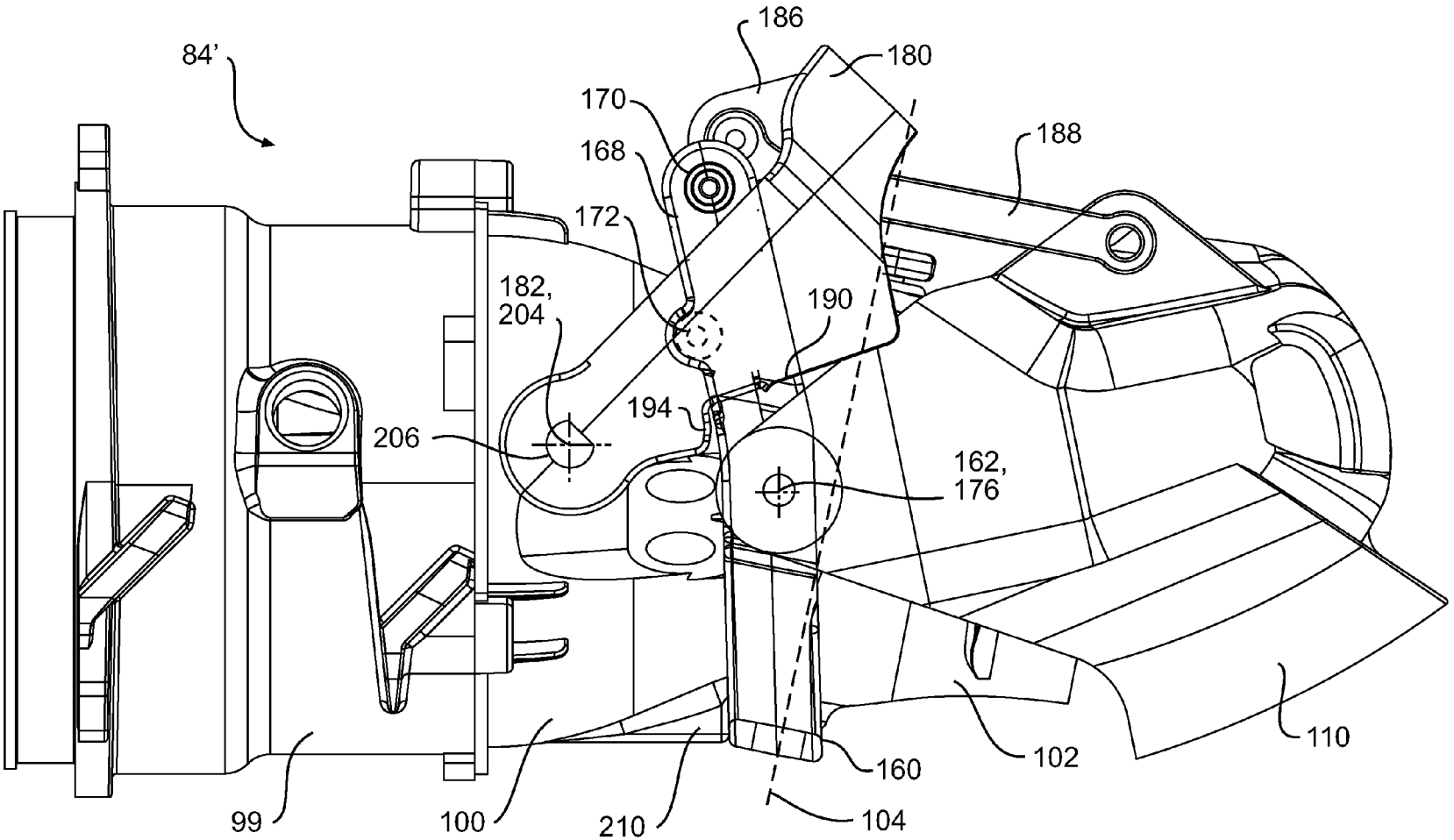
FIG. 21 is a left side view of a second embodiment of a jet propulsion system according to the present invention with the VTS in a VTS down position and the reverse gate in a lowered position.
Figure 22:
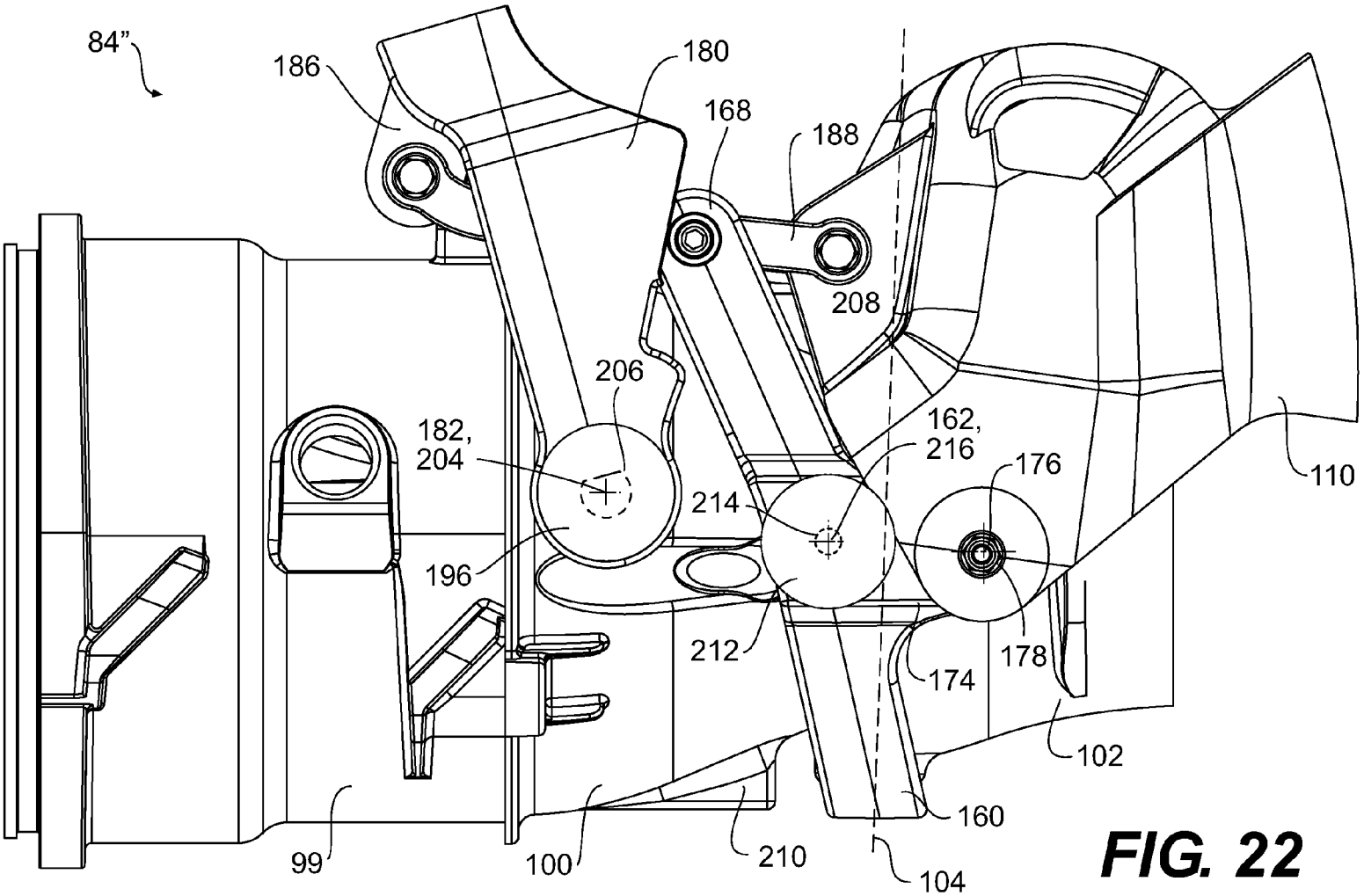
FIG. 22 is a left side view of a third embodiment of a jet propulsion system according to the present invention with the VTS in a VTS neutral position and the reverse gate in a stowed position.
Figure 23:
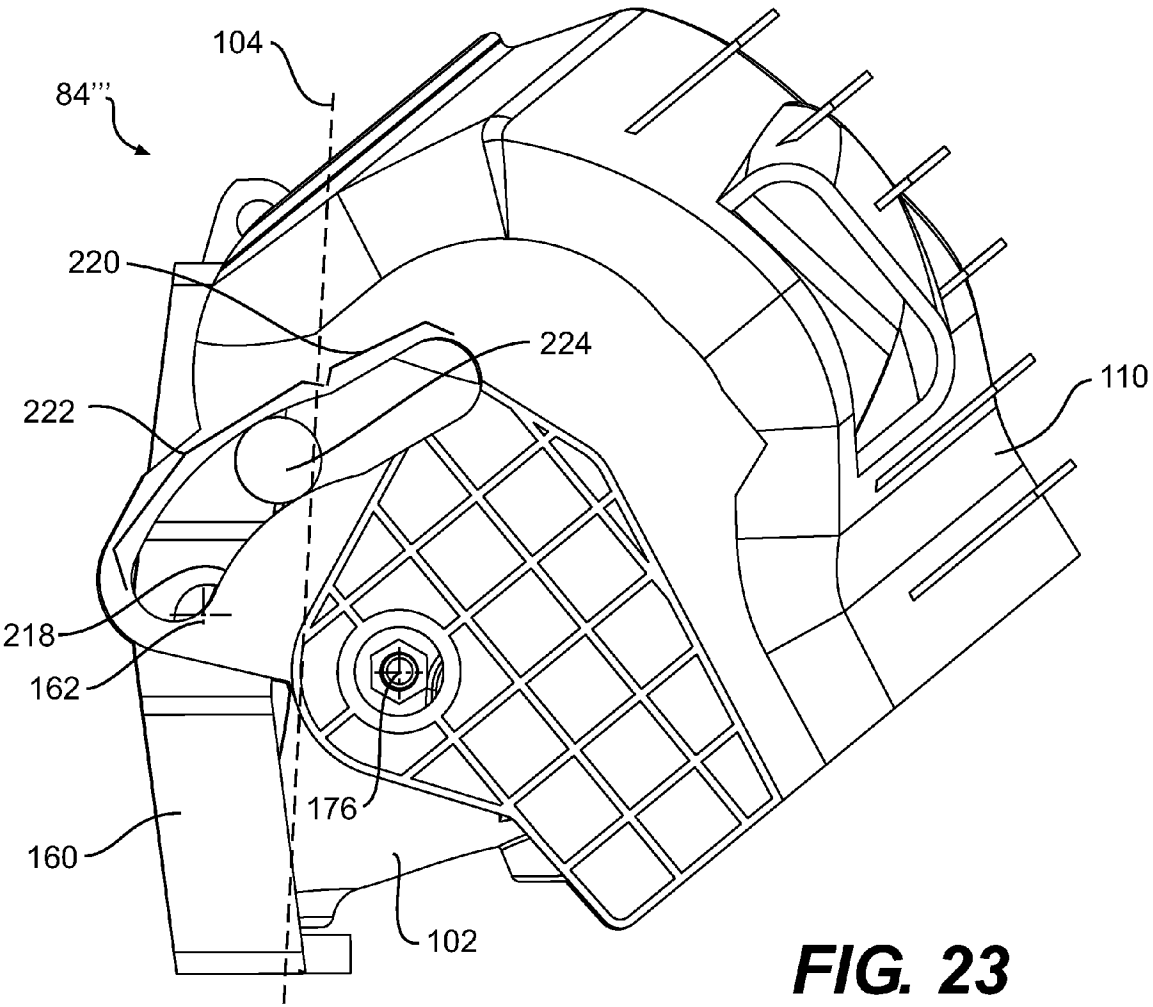
FIG. 23 is a left side view of a fourth embodiment of a jet propulsion system according to the present invention with the VTS in a VTS down position and the reverse gate in a lowered position.

FIGS. 21, 22 and 23 illustrate alternative embodiments of the jet propulsion system 84 described above. For simplicity, like components have been labelled with the same reference number as in the embodiment described above and will not be described again.

FIG. 21 illustrates a jet propulsion system 84' where the VTS axis 162 and the reverse gate axis 176 are coaxial. Rotation of the output portion 202 of the rotary actuator 196 results in the same movement of the components as described above with respect to jet propulsion system 84, except that from the VTS up position to the VTS down position, the reverse gate 110 rotates about the reverse gate axis 176 to remain in the stowed position relative to the steering nozzle 102 instead of moving in an arc as in the above embodiment.

FIG. 22 illustrates a jet propulsion system 84" where a second rotary actuator 212 having a second output portion 214 is connected to the VTS support 160. An axis of rotation 216 of the second output portion 214 is coaxial with the VTS axis 162. Since the VTS support 160 is provided with its own actuator 212, guide pins 170 and 172 have been removed since the main support 180 no longer needs to cause its movement from the VTS up to the VTS down position. By properly synchronising the actuators 196 and 212, it is possible to obtain the same movement of the components as described above with respect to jet propulsion system 84.

Another embodiment (not shown) of a jet propulsion system is also contemplated. This embodiment would have the reverse gate axis 176 coaxial with the VTS axis 162 like jet propulsion system 84', but the main support 180 is omitted. Instead, two rotary actuators are provided. One rotary actuator is disposed on one side of the jet propulsion system and is connected to the VTS support 160 (like actuator 212 of jet propulsion system 84"). The other rotary actuator is disposed on the other side of the jet propulsion system and is connected to the reverse gate 110 (the axis of rotation of the actuator being coaxial with the reverse gate axis 176). As in jet propulsion system 84", by properly synchronising the two actuators, it is possible to obtain the same movement of the components as described above with respect to jet propulsion system 84. An embodiment where two rotary actuators are provided as described above, but where the reverse gate axis 176 and the VTS axis 162 are offset from each other is also contemplated.

FIG. 23 illustrates a jet propulsion system 84'" where a rotary actuator (not shown) is connected to the reverse gate 110 so as to rotate the reverse gate 110 about the reverse gate axis 176. The reverse gate 110 has a slot 218 having a straight portion 220 and a curved portion 222. It is contemplated that the slot 218 could be replaced by a groove in the reverse gate 110. The VTS support 160 has a guide pin 224 thereon that fits inside the slot 218. When the reverse gate 110 is rotated such that the guide pin 224 slides in the straight portion 220 of the slot 218, the VTS support 160 rotates about VTS axis 162 and the reverse gate 110 rotates about the reverse gate axis 176, however the position of the reverse gate 110 relative to the VTS support 160 remains substantially the same (i.e. a stowed position). When the reverse gate 110 is rotated such that the guide pin 224 slides in the curved portion 222 of the slot 218, the VTS support 160 is in the VTS down position for all positions of the reverse gate 110 and the reverse gate 110 rotates about the reverse gate axis 176 to positions where the reverse gate 110 redirects a jet of water expelled from the steering nozzle 102 when the engine 22 is in operation.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A watercraft comprising:

a hull;

a deck disposed on the hull;

an engine compartment defined between the hull and the deck;

an engine disposed in the engine compartment;

a steering assembly disposed at least in part on the deck;

a jet pump connected to the hull and being operatively connected to the engine;

a venturi connected to a rearward end of the jet pump;

a variable trim system (VTS) support rotationally mounted relative to the venturi about a VTS axis, the VTS axis extending generally laterally and horizontally;

a steering nozzle rotationally mounted to the VTS support about a steering axis such that the steering nozzle rotates about the VTS axis with the VTS support, the steering axis being generally perpendicular to the VTS axis, the steering nozzle being operatively connected to the steering assembly and being disposed at least in part rearwardly of the venturi;

a reverse gate rotationally mounted relative to the venturi about a reverse gate axis, the reverse gate axis extending generally laterally and horizontally; and a rotary actuator having an output portion operatively connected to at least one of the VTS support and the reverse gate, the output portion being rotatable between a first angle, a second angle, and a third angle, rotation of the output portion between the first angle and the second angle causing a rotation of the VTS support about the VTS axis while a position of the reverse gate relative to the VTS support remains substantially the same, the position of the reverse gate relative to the VTS support being a stowed position, and rotation of the output portion between the second angle and the third angle causing a rotation of the reverse gate about the reverse gate axis between the stowed position and a second position while the VTS support remains in a fixed position relative to the venturi, the second position being a position wherein the reverse gate redirects a jet of water expelled from the steering nozzle when the engine is in operation.

2. The watercraft of claim 1, wherein the VTS support is a VTS ring encircling at least a portion of the steering nozzle; and wherein the steering nozzle is rotationally mounted to the VTS ring about the steering axis at a top and at a bottom of the VTS ring.

3. The watercraft of claim 1, wherein the reverse gate is rotationally mounted to the VTS support about the reverse gate axis; and wherein the reverse gate axis is coaxial with the VTS axis.

4. The watercraft of claim 1, wherein the reverse gate is rotationally mounted to the VTS support about the reverse gate axis;

wherein the reverse gate axis is disposed rearwardly of the VTS axis; and wherein rotation of the output portion between the first angle and the second angle causes movement of the reverse gate axis in an arc about the VTS axis.

5. The watercraft of claim 1, further comprising a main support rotationally mounted relative to the venturi about a main support axis, the main support axis extending generally laterally and horizontally and being disposed forwardly of the VTS axis;

wherein the reverse gate is operatively connected to the main support; and wherein the output portion of the rotary actuator is connected to the main support, an axis of rotation of the output portion being coaxial with the main support axis.

6. The watercraft of claim 5, wherein the rotary actuator having the output portion is a first rotary actuator having a first output portion; and further comprising a second rotary actuator having a second output portion, the second output portion of the second rotary actuator being connected to the VTS support for rotating the VTS support, an axis of rotation of the second output portion being coaxial with the VTS axis.

7. The watercraft of claim 5, further comprising:

a tunnel formed in the hull, the tunnel having a front wall, a top wall, and two side walls; and a ride plate mounted to the hull for at least partially closing a bottom of the tunnel;

wherein the jet pump is disposed at least in part in the tunnel;

wherein the VTS support is rotationally mounted to the two side walls of the tunnel about the VTS axis; and wherein the main support is rotationally mounted to at least one of the two side walls of the tunnel about the main support axis.

8. The watercraft of claim 7, wherein the rotary actuator is disposed inside the hull adjacent one of the two side walls of the tunnel.

9. A jet propulsion system comprising:

a jet pump;

a venturi connected to an end of the jet pump;

a variable trim system (VTS) support rotationally mounted relative to the venturi about a VTS axis, the VTS axis extending generally laterally and horizontally;

a steering nozzle rotationally mounted to the VTS support about a steering axis such that the steering nozzle rotates about the VTS axis with the VTS support, the steering axis being generally perpendicular to the VTS axis, the venturi being disposed longitudinally between the jet pump and the steering nozzle;

a reverse gate rotationally mounted to the VTS support about a reverse gate axis, the reverse gate axis extending generally laterally and horizontally;

a main support rotationally mounted relative to the venturi about a main support axis, the main support axis extending generally laterally and horizontally, the VTS axis being disposed rearwardly of the main support axis; and at least one link having a first portion pivotally connected to the main support and a second portion pivotally connected to the reverse gate.

10. The jet propulsion system of claim 9, wherein the VTS support is a VTS ring encircling at least a portion of the steering nozzle; and wherein the steering nozzle is rotationally mounted to the VTS ring about the steering axis at a top and at a bottom of the VTS ring.

11. The jet propulsion system of claim 9, wherein the VTS axis is disposed longitudinally between the reverse gate axis and the main support axis.

12. The jet propulsion system of claim 9, wherein the venturi has a stopper portion disposed on a lower portion thereof;

wherein the VTS support, the reverse gate, and the main support are movable between a first arrangement, a second arrangement, and a third arrangement;

wherein when in the first arrangement, the main support is in a first position, the reverse gate is in a stowed position relative to the steering nozzle and contacts the VTS support at a contact point located vertically higher than the reverse gate axis, and a bottom portion of the VTS support is spaced from the stopper portion of the venturi;

wherein when in the second arrangement, the main support is in a second position rotated in a first direction from the first position, the reverse gate is in the stowed position and contacts the VTS support at the contact point, and the bottom portion of the VTS support contacts the stopper portion of the venturi; and wherein when in the third arrangement, the main support is in a third position rotated in the first direction from the second position, the reverse gate is in a position where the reverse gate redirects a jet of water expelled from the steering nozzle when the jet propulsion system is in operation, the reverse gate is spaced from the contact point, and the bottom portion of the VTS support contacts the stopper portion of the venturi.

13. The jet propulsion system of claim 12, further comprising a first guide pin disposed on the VTS support vertically higher than the VTS axis;

wherein the main support defines a contact surface on a rearwardly facing side thereof; and wherein as the VTS support, the reverse gate, and the main support are moved between the first arrangement and the second arrangement the first guide pin contacts the contact surface.

14. The jet propulsion system of claim 13, wherein the main support defines a slot therein, the slot defines an opening at an upper end of the contact surface; and wherein as the VTS support, the reverse gate, and the main support are moved between the second arrangement and the third arrangement the first guide pin is disposed in the slot.

15. The jet propulsion system of claim 14, further comprising a second guide pin disposed on the VTS support vertically higher than the VTS axis and vertically lower than the first guide pin;

wherein the main support defines a ramp, the ramp having an arcuate surface, the arcuate surface corresponding to a segment of a circle having the main support axis as a center; and wherein when the steering nozzle, the reverse gate, and the main support are moved between the second arrangement and the third arrangement the second guide pin contacts the arcuate surface of the ramp.

16. The jet propulsion system of claim 9, further comprising an actuator operatively connected to the main support for rotating the main support about the main support axis.

17. A method of operating a jet propulsion system, the jet propulsion system including a jet pump, a venturi connected to the jet pump, a variable trim system (VTS) support rotationally mounted relative to the venturi about a VTS axis, the VTS axis extending generally laterally and horizontally, a steering nozzle rotationally mounted to the VTS support about a steering axis such that the steering nozzle rotates about the VTS axis with the VTS support, the steering axis being generally perpendicular to the VTS axis, a reverse gate rotationally mounted relative to the venturi about a reverse gate axis, the reverse gate axis extending generally laterally and horizontally, and a rotary actuator having an output portion operatively connected to the VTS support, the method comprising:

rotating the output portion of the rotary actuator in a first direction thereby causing the VTS support to rotate from a VTS up position to a VTS down position about the VTS axis;

moving the reverse gate such that a position of the reverse gate relative to the VTS support remains substantially the same as the VTS support is rotated, the reverse gate being in a stowed position relative to the steering nozzle; and continuing to rotate the output portion of the rotary actuator in the first direction once the VTS support reaches the VTS down position thereby causing the reverse gate to rotate from the stowed position to a second position where the reverse gate redirects a jet of water expelled from the steering nozzle when the jet propulsion system is in operation, the VTS support remaining in the VTS down position as the reverse gate is rotated from the stowed position to the second position.

18. The method of claim 17, wherein moving the reverse gate such that a position of the reverse gate relative to the VTS support remains substantially the same as the VTS support is rotated includes moving the reverse gate axis in an arc about the VTS axis as the VTS support is rotated from the VTS up position to the VTS down position.

19. The method of claim 17, wherein the jet propulsion system further includes a main support rotationally mounted relative to the venturi about a main support axis, the main support axis extending generally laterally and horizontally and being disposed forwardly of the VTS axis, the reverse gate being operatively connected to the main support, and the output portion of the rotary actuator being operatively connected to the main support;

wherein rotating the output portion of the rotary actuator in a first direction thereby causing the VTS support to rotate from a VTS up position to a VTS down position about the VTS axis includes:

rotating the main support in the first direction using the output portion of the rotary actuator thereby causing rotation of the VTS support from the VTS up position to the VTS down position; and wherein continuing to rotate the output portion of the rotary actuator in the first direction once the VTS support reaches the VTS down position includes:

continuing to rotate the main support in the first direction using the rotary actuator thereby causing rotation of the reverse gate from the stowed position to the second position.

* * * * *